US007097963B1

(12) United States Patent
Zou et al.

(10) Patent No.: US 7,097,963 B1
(45) Date of Patent: Aug. 29, 2006

(54) HALOGEN SUBSTITUTED TETRAAZAINDENE COMPOUNDS IN PHOTOTHERMOGRAPHIC MATERIALS

(75) Inventors: Chaofeng Zou, Maplewood, MN (US); Kumars Sakizadeh, Woodbury, MN (US); George J. Burgmaier, Pittsford, NY (US); Roger L. Klaus, Victor, NY (US)

(73) Assignee: Eastman Kodak Company, Rochester, NY (US)

( * ) Notice: Subject to any disclaimer, the term of this patent is extended or adjusted under 35 U.S.C. 154(b) by 6 days.

(21) Appl. No.: 11/108,511

(22) Filed: Apr. 18, 2005

(51) Int. Cl.
*G03C 1/00* (2006.01)
*G03C 1/06* (2006.01)
*G03C 5/16* (2006.01)
*G03C 8/00* (2006.01)

(52) U.S. Cl. ..... 430/617; 430/618; 430/619; 430/620; 430/607; 430/613; 430/614; 430/615; 430/203; 430/348; 430/350

(58) Field of Classification Search ..... 430/617, 430/618, 619, 620, 203, 348, 350, 607, 613–615
See application file for complete search history.

(56) References Cited

U.S. PATENT DOCUMENTS 4,404,390 A 9/1983 Altland et al.
5,691,127 A * 11/1997 Daubendiek et al. ..... 430/567
5,968,725 A * 10/1999 Katoh et al. ..... 430/619
6,207,364 B1 3/2001 Takamuki et al.
6,413,710 B1 7/2002 Shor et al.
6,497,999 B1 12/2002 Bryant et al.
6,548,236 B1 4/2003 Irving et al.
6,576,411 B1 6/2003 Irving et al.
2005/0106514 A1* 5/2005 Eckert et al. ..... 430/619

FOREIGN PATENT DOCUMENTS

JP 10-104784 10/1998

OTHER PUBLICATIONS

*Research Disclosure*, Item 20338, Mar. 1981.

* cited by examiner

*Primary Examiner*—Geraldine Letscher
(74) *Attorney, Agent, or Firm*—J. Lanny Tucker; Louis M. Leichter

(57) ABSTRACT

Black-and-white, aqueous-based, silver halide-containing photothermographic materials have increased stability after imaging with the incorporation of at least 0.0002 mol/m$^2$ of a halogen-substituted tetraazaindene compound.

19 Claims, No Drawings

HALOGEN SUBSTITUTED TETRAAZAINDENE COMPOUNDS IN PHOTOTHERMOGRAPHIC MATERIALS

FIELD OF THE INVENTION

This invention relates to aqueous-based photothermographic materials having improved stability and to methods of imaging these materials.

BACKGROUND OF THE INVENTION

Silver-containing photothermographic imaging materials (that is, photosensitive thermally developable imaging materials) that are imaged with actinic radiation and then developed using heat and without liquid processing have been known in the art for many years. Such materials are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. This reaction occurs preferentially in the regions surrounding the latent image. This reaction produces a negative image of metallic silver having a color that ranges from yellow to deep black depending upon the presence of toning agents and other components in the photothermographic imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

In photothermographic imaging materials, a visible image is created in the absence of processing solvent by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example, a silver carboxylate or a silver benzotriazole) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. The incorporation of the developer into photothermographic materials can lead to increased formation of various types of "fog" or other undesirable sensitometric side effects. Therefore, much effort has gone into the preparation and manufacture of photothermographic materials to minimize these problems.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Unconventional Imaging Processes*, E. Brinckman et al. (Eds.), The Focal Press, London and New York, 1978, pp. 74–75, in D. H. Klosterboer, *Imaging Processes and Materials*, (*Neblette's Eighth Edition*), J. Sturge, V. Walworth, and A. Shepp, Eds., Van Nostrand-Reinhold, New York, 1989, Chapter 9, pp. 279–291, in Zou et al., *J. Imaging Sci. Technol.* 1996, 40, pp. 94–103, and in M. R. V. Sahyun, *J. Imaging Sci. Technol.* 1998, 42, 23.

Problem to be Solved

A challenge in photothermographic materials is the need to improve their stability at ambient temperature and relative humidity during storage prior to imaging. This stability is referred to as "Natural Age Keeping" (NAK), "Raw Stock Keeping" (RSK) or Shelf-Life Stability. It is desirable that photothermographic materials be capable of maintaining imaging properties, including photospeed and $D_{max}$, while minimizing any increase in $D_{min}$ during storage periods. Natural Age Keeping is a problem for photothermographic materials compared to conventional silver halide photographic films because, as noted above, all the components needed for development and image formation in photothermographic systems are incorporated into the imaging element, in intimate proximity, prior to development. Thus, there are a greater number of potentially reactive components that can prematurely react during storage. It is more particularly a problem for aqueous-based photothermographic materials that are prepared using aqueous formulations that leave residual water in the layers.

Another challenge in photothermographic materials is the need to improve the "Dark Stability" (also known as "Archival Stability") of the imaged and processed photothermographic film upon storage in the dark at a given temperature and humidity. It is desirable that the $D_{min}$ not increase, and that the $D_{max}$, tint, and tone of the image not change.

A further challenge in photothermographic materials is the need to improve their stability to light exposure after imaging and processing. Referred to as "Desktop Print Stability," the formation of additional image or "print-out" is usually most evident as an increase in $D_{min}$. This effect tends to be especially problematic under high humidity conditions.

The use of 4-hydroxy-6-methyl-1,3,3a,7-tetraazaindene as an antifoggant in a heat-developable material is described in U.S. Pat. No. 4,404,390 (Altland et al.). U.S. Pat. No. 6,413,710 (Shor et al.) describes the use of hydroxy-tetraazaindenes during the preparation of silver halide grains to increase sensitivity from chemical sensitization.

There remains a need to improve Natural Age Keeping, Dark Stability, and Desktop Print Stability without sacrificing desired photospeed and other sensitometric properties.

SUMMARY OF THE INVENTION

The problems are solved with a black-and-white aqueous-based photothermographic material comprising a support and having thereon at least one photothermographic imaging layer comprising a hydrophilic polymer binder or a water-dispersible polymer latex binder and in reactive association:

a. a photosensitive silver halide, b. a non-photosensitive source of reducible silver ions, c. a reducing agent for the reducible silver ions, and d. at least 0.00002 mol/m$^2$ of a halogen-substituted tetraazaindene compound.

In preferred embodiments, the invention provides a black-and-white photothermographic material comprising a support having on a frontside thereof, a) one or more frontside photothermographic imaging layers comprising a hydrophilic polymer binder or a water-dispersible polymer latex binder, and in reactive association, a photosensitive silver halide, a non-photosensitive source of reducible silver ions, and a reducing agent for the non-photosensitive source reducible silver ions, b) the material comprising on the backside of the support, one or more backside photothermographic imaging layers having the same or different composition as the photothermographic imaging layers, and c) optionally, an outermost protective layer disposed over the one or more photothermographic imaging layers on either or both sides of the support, wherein the material further comprises, on one or both sides of the support, at least 0.0002 mol/m$^2$ of a halogen-substituted tetraazaindene compound.

This invention also provides a method of forming a visible image comprising:

(A) imagewise exposing a photothermographic material of this invention to electromagnetic radiation to form a latent image, (B) simultaneously or sequentially, heating the exposed photothermographic material to develop the latent image into a visible image.

We have found that the incorporation of certain halogen-substituted tetraazaindene compounds into aqueous-based photothermographic materials improves their Natural Age Keeping, Dark Stability, and Desktop Print Stability properties without significant losses in other desired properties, for example photospeed and silver efficiency. As opposed to known tetraazaindene compounds used in photothermographic materials, the compounds useful in the present invention have a halo substituent in the 5-position of the ring.

DETAILED DESCRIPTION OF THE INVENTION

The photothermographic materials can be used in black-and-white photothermography and in electronically generated black-and-white hardcopy recording. They can be used in microfilm applications, in radiographic imaging (for example digital medical imaging), X-ray radiography, and in industrial radiography. Furthermore, in some embodiments, the absorbance of these materials between 350 and 450 nm is desirably low (less than 0.5), to permit their use in the graphic arts area (for example, imagesetting and phototypesetting), in the manufacture of printing plates, in contact printing, in duplicating ("duping"), and in proofing.

The photothermographic materials are particularly useful for medical imaging of human or animal subjects in response to visible or X-radiation for use in medical diagnosis. Such applications include, but are not limited to, thoracic imaging, mammography, dental imaging, orthopedic imaging, general medical radiography, therapeutic radiography, veterinary radiography, and autoradiography. When used with X-radiation, the photothermographic materials may be used in association with one or more phosphor intensifying screens, with phosphors incorporated within the photothermographic emulsion, or with a combination thereof. The photothermographic materials are also useful for non-medical uses of visible or X-radiation (such as X-ray lithography and industrial radiography). In these and other imaging applications, it is particularly desirable that the photothermographic materials be "double-sided."

The photothermographic materials can be made sensitive to radiation of any suitable wavelength. Thus, in some embodiments, the materials are sensitive at ultraviolet, visible, near infrared, or infrared wavelengths, of the electromagnetic spectrum. In these embodiments, the materials are preferably sensitive to radiation greater than 300 nm (such as sensitivity to, from about 300 nm to about 850 nm, preferably from about 300 to about 600 nm, and more preferably from about 300 to about 450 nm). In other embodiments they are sensitive to X-radiation. Increased sensitivity to X-radiation can be imparted through the use of phosphors.

In some embodiments of the photothermographic materials, the components needed for imaging can be in one or more imaging or emulsion layers on one side ("frontside") of the support. The layer(s) that contain the photosensitive photocatalyst (such as a photosensitive silver halide) for photothermographic materials or the non-photosensitive source of reducible silver ions, or both, are referred to herein as the emulsion layer(s). In photothermographic materials, the photocatalyst and non-photosensitive source of reducible silver ions are in catalytic proximity and preferably are in the same emulsion layer.

Where the photothermographic materials contain imaging layers on one side of the support only, various non-imaging layers can also be disposed on the "backside" (non-emulsion or non-imaging side) of the materials, including, conductive layers, antihalation layer(s), protective layers, antistatic layers, and transport enabling layers.

In such instances, various non-imaging layers can also be disposed on the "frontside" or imaging or emulsion side of the support, including protective overcoat layers, primer layers, interlayers, opacifying layers, antistatic layers, antihalation layers, acutance layers, auxiliary layers, and other layers readily apparent to one skilled in the art.

For preferred embodiments, the photothermographic materials are "double-sided" or "duplitized" and have the same or different emulsion coatings (or photothermographic imaging layers) on both sides of the support. Such constructions can also include one or more protective overcoat layers, primer layers, interlayers, antistatic layers, acutance layers, antihalation layers, auxiliary layers, conductive layers, and other layers readily apparent to one skilled in the art on either or both sides of support. Preferably, such photothermographic materials have essentially the same layers on each side of the support.

When the photothermographic materials are heat-developed as described below in a substantially water-free condition after, or simultaneously with, imagewise exposure, a silver image (preferably a black-and-white silver image) is obtained.

Definitions

As used herein:

In the descriptions of the photothermographic materials, "a" or "an" component refers to "at least one" of that component (for example, the halogen-substituted tetraazaindene compounds described herein).

The term "black-and-white" refers to an image formed by silver metal.

Unless otherwise indicated, the terms "photothermographic materials" and "imaging assemblies" are used herein in reference to embodiments of the present invention.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Aqueous-based" means that the solvent in which the imaging layer is prepared and coated is predominantly (greater than 90%) water.

"Photothermographic material(s)" means a dry processable integral material comprising at least one photothermographic emulsion layer or a photothermographic set of emulsion layers (wherein the photosensitive silver halide and the source of reducible silver ions, are in one layer and the other essential components or desirable additives are distributed, as desired, in the same layer or in an adjacent coated layer) that provides a black-and-white silver image. These materials also include multilayer constructions in which one or more imaging components are in different layers, but are in "reactive association." For example, one layer can include the non-photosensitive source of reducible silver ions and another layer can include the reducing agent and/or photosensitive silver halide. By "integral," we mean that all imaging chemistry required for imaging is in the material without diffusion of imaging chemistry or reaction products (such as a dye) from or to another element (such as a receiver element).

When used in photothermography, the term, "imagewise exposing" or "imagewise exposure" means that the material is imaged using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

"Catalytic proximity" or "reactive association" means that the materials are in the same layer or in adjacent layers so that they readily come into contact with each other during thermal imaging and development.

"Emulsion layer," "imaging layer," or "photothermographic imaging layer," means a layer of a photothermographic material that contains the photosensitive silver halide and/or non-photosensitive source of reducible silver ions. It can also mean a layer of the material that contains, in addition to the photosensitive silver halide and/or non-photosensitive source of reducible ions, additional essential components and/or desirable additives such as the reducing agent(s). In singles-sided materials, these layers are usually on what is known as the "frontside" of the support.

The terms "double-sided" and "duplitized" are used to define photothermographic materials having one or more of the same or different photothermographic emulsion layers disposed on both sides (front and back) of the support. In double-sided materials the emulsion layers can be of the same or different chemical composition, thickness, or sensitometric properties.

In addition, "frontside" also generally means the side of a photothermographic material that is first exposed to imaging radiation, and "backside" generally refers to the opposite side of the photothermographic material.

"Photocatalyst" means a photosensitive compound such as silver halide that, upon exposure to radiation, provides a compound that is capable of acting as a catalyst for the subsequent development of the photothermographic material.

Many of the materials used herein are provided as a solution. The term "active ingredient" means the amount or the percentage of the desired material contained in a sample. All amounts listed herein are the amount of active ingredient added.

"Simultaneous coating" or "wet-on-wet" coating means that when multiple layers are coated, subsequent layers are coated onto the initially coated layer before the initially coated layer is dry.

"Ultraviolet region of the spectrum" refers to that region of the spectrum less than or equal to 400 nm, and preferably from about 100 nm to about 400 nm, although parts of these ranges may be visible to the naked human eye. More preferably, the ultraviolet region of the spectrum is the region of from about 190 nm to about 400 nm. The near ultraviolet region of the spectrum refers to that region of from about 300 to about 400 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Blue region of the spectrum" refers to that region of the spectrum of from about 400 nm to about 500 nm.

"Green region of the spectrum" refers to that region of the spectrum of from about 500 nm to about 600 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

"Transparent" means capable of transmitting visible light or imaging radiation without appreciable scattering or absorption.

The sensitometric terms "photospeed," "speed," or "photographic speed" (also known as sensitivity), absorbance, contrast, $D_{min}$, and $D_{max}$ have conventional definitions known in the imaging arts. In photothermographic materials, $D_{min}$ is considered herein as image density achieved when the photothermographic material is thermally developed without prior exposure to radiation. It is the average of eight lowest density values on the exposed side of the fiducial mark.

In photothermographic materials, the term $D_{max}$ is the maximum image density achieved when the photothermographic material is exposed to a particular radiation source and a given amount of radiation energy and then thermally developed.

The terms "density," "optical density (OD)," and "image density" refer to the sensitometric term absorbance.

Speed-1 is Log1/E+4 corresponding to the density value of 0.60 above $D_{min}$ where E is the exposure in ergs/cm$^2$.

Speed-2 is Log1/E+4 corresponding to the density value of 1.0 above $D_{min}$ where E is the exposure in ergs/cm$^2$.

"Desktop Print Stability" is the stability of the imaged and processed film when stored for a period of time under given conditions of temperature, relative humidity, and light exposure. It is one type of post-processing stability.

"Natural Age Keeping" (NAK), also known as "Raw Stock Keeping" (RSK) or Shelf-Life Stability, is the stability of the non-imaged film when stored in the dark for a period of time under a given set of temperature and relative humidity conditions.

"Dark Stability," also known as "Archival Stability," is the stability of the imaged and processed film when stored in the dark for a period of time under given conditions of temperature and relative humidity. It is one type of post-processing stability.

Silver Efficiency is defined as $D_{max}$ divided by the silver coating weight. It is a measure of the amount of silver that has developed under a given set of exposure and development conditions.

"Natural Age Keeping" (NAK), also known as "Raw Stock Keeping" (RSK), or "Shelf-Life Stability" is the stability of the non-imaged film when stored in the dark for a period of time under a given set of temperature and relative humidity conditions.

"Aspect ratio" refers to the ratio of particle or grain "ECD" to particle or grain thickness wherein ECD (equivalent circular diameter) refers to the diameter of a circle having the same projected area as the particle or grain.

The phrase "silver salt" refers to an organic molecule capable of forming a bond with a silver atom. Although the compounds so formed are technically silver coordination complexes or silver compounds they are also often referred to as silver salts.

In the compounds described herein, no particular double bond geometry (for example, cis or trans) is intended by the structures drawn unless otherwise specified. Similarly, in compounds having alternating single and double bonds and localized charges their structures are drawn as a formalism. In reality, both electron and charge delocalization exists throughout the conjugated chain.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of, or as "a derivative" of, a given formula, any substitution that does not alter the bond structure of the formula or the shown atoms within that structure is included within the formula, unless such substitution is specifically excluded by language.

As a means of simplifying the discussion and recitation of certain substituent groups, the term "group" refers to chemical species that may be substituted as well as those that are not so substituted. Thus, the term "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxy, alkoxy, phenyl, halogen atoms (F, Cl, Br, and I), cyano, nitro, amino, and carboxy. For example, alkyl group includes ether and thioether groups (for example $CH_3$—$CH_2$—$CH_2$—O—$CH_2$— and $CH_3$—$CH_2$—$CH_2$—S—$CH_2$—), hydroxyalkyl (such as 1,2-dihydroxyethyl), haloalkyl, nitroalkyl, alkylcarboxy, carboxyalkyl, carboxamido, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* (http://www.researchdisclosure.com) is a publication of Kenneth Mason Publications Ltd., The Book Barn, Westbourne, Hampshire PO10 8RS, UK. It is also available from Emsworth Design Inc., 200 Park Avenue South, Room 1101, New York, N.Y. 10003.

Other aspects, advantages, and benefits of the present invention are apparent from the detailed description, examples, and claims provided in this application.

The Photocatalyst

The photothermographic materials include one or more photocatalysts in the photothermographic emulsion layer(s). Useful photocatalysts are typically photosensitive silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver bromoiodide are more preferred silver halides, with the latter silver halide having up to nearly 100 mol % silver iodide (more preferably up to 40 mol %) silver iodide, based on total silver halide, and up to the saturation limit of iodide as described in U.S. Patent Application Publication 2004/0053173 (Maskasky et al.).

The shape (morphology) of the photosensitive silver halide grains used in the present need not be limited. The silver halide grains may have any crystalline habit including cubic, octahedral, tetrahedral, orthorhombic, rhombic, dodecahedral, other polyhedral, tabular, laminar, twinned, or platelet morphologies and may have epitaxial growth of crystals thereon. If desired, a mixture of these crystals can be employed. Silver halide grains having cubic and tabular morphology (or both) are preferred. More preferably, the silver halide grains are predominantly (at least 50% based on total silver halide) present as tabular grains.

The silver halide grains may have a uniform ratio of halide throughout. They may have a graded halide content, with a continuously varying ratio of, for example, silver bromide and silver iodide or they may be of the core-shell type, having a discrete core of one or more silver halides, and a discrete shell of one of more different silver halides. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

In some instances, it may be helpful to prepare the photosensitive silver halide grains in the presence of a hydroxytetraazaindene or an N-heterocyclic compound comprising at least one mercapto group as described in U.S. Pat. No. 6,413,710 (Shor et al.), that is incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halide grains be preformed and prepared by an ex-situ process, chemically and spectrally sensitized, and then be added to and physically mixed with the non-photosensitive source of reducible silver ions.

It is also possible, but less preferred, to form the source of reducible silver ions in the presence of ex-situ-prepared silver halide grains. In this process, the source of reducible silver ions is formed in the presence of the preformed silver halide grains. Precipitation of the reducible source of silver ions in the presence of silver halide provides a more intimate mixture of the two materials [see, for example U.S. Pat. No. 3,839,049 (Simons)] to provide a "preformed emulsion." This method is useful when non-tabular silver halide grains are used.

It is also possible to form some in-situ silver halide, by a process in which an inorganic halide- or an organic halogen-containing compound is added to an organic silver salt to partially convert the silver of the organic silver salt to silver halide as described in U.S. Pat. No. 3,457,075 (Morgan et al.).

In general, the non-tabular silver halide grains used in this invention can vary in average diameter of up to several micrometers (μm) and they usually have an average particle size of from about 0.01 to about 1.5 μm (preferably from about 0.03 to about 1.0 μm, and more preferably from about 0.05 to about 0.8 μm). The average size of the photosensitive silver halide grains is expressed by the average diameter if the grains are spherical, and by the average of the diameters of equivalent circles for the projected images if the grains are cubic, tabular, or other non-spherical shapes. Representative grain sizing methods are described by in *Particle Size Analysis*, ASTM Symposium on Light Microscopy, R. P. Loveland, 1955, pp. 94–122, and in C. E. K. Mees and T. H. James, *The Theory of the Photographic Process*, Third Edition, Macmillan, New York, 1966, Chapter 2.

In preferred embodiments of this invention, the silver halide grains are provided predominantly (based on at least 50 mol % silver) as tabular silver halide grains that are considered "ultrathin" and have an average thickness of at least 0.02 μm and up to and including 0.10 μm (preferably an average thickness of at least 0.03 μm and more preferably of at least 0.04 μm, and up to and including 0.08 μm and more preferably up to and including 0.07 μm).

In addition, these ultrathin tabular grains have an equivalent circular diameter (ECD) of at least 0.5 μm (preferably at least 0.75 μm, and more preferably at least 1 μm). The ECD can be up to and including 8 μm (preferably up to and including 6 μm, and more preferably up to and including 4 μm).

The aspect ratio of the useful tabular grains is at least 5:1 (preferably at least 10:1, and more preferably at least 15:1) and generally up to 50:1. The grain size of ultrathin tabular grains may be determined by any of the methods commonly employed in the art for particle size measurement, such as those described above. Ultrathin tabular grains and their method of preparation and use in photothermographic materials are described in U.S. Pat. No. 6,576,410 (Zou et al.) and U.S. Pat. No. 6,673,529 (Daubendiek et al.) that are incorporated herein by reference.

The ultrathin tabular silver halide grains can also be doped using one or more of the conventional metal dopants known for this purpose including those described in *Research Disclosure*, item 38957, September 1996 and U.S. Pat. No. 5,503,970 (Olm et al.), incorporated herein by reference. Preferred dopants include iridium (III or IV) and ruthenium (II or III) salts. Particularly preferred silver halide grains are ultrathin tabular grains containing iridium-doped azole ligands. Such tabular grains and their method of preparation are described in U.S. Pat. No. 6,969,582 (Olm et al.) that is incorporated herein by reference.

The one or more light-sensitive silver halides used in the photothermographic materials are preferably present in an amount of from about 0.005 to about 0.5 mole (more preferably from about 0.01 to about 0.25 mole, and most preferably from about 0.03 to about 0.15 mole) per mole of non-photosensitive source of reducible silver ions.

Chemical Sensitizers

If desired, the photosensitive silver halides used in the photothermographic materials can be chemically sensitized using any useful compound that contains sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149–169. Suitable conventional chemical sensitization procedures and compounds are also described in U.S. Pat. No. 1,623,499 (Sheppard et al.), U.S. Pat. No. 2,399,083 (Waller et al.), U.S. Pat. No. 3,297,446 (Dunn), U.S. Pat. No. 3,297,447 (McVeigh), U.S. Pat. No. 5,049,485 (Deaton), U.S. Pat. No. 5,252,455 (Deaton), U.S. Pat. No. 5,391,727 (Deaton), U.S. Pat. No. 5,691,127 (Daubendiek et al.), U.S. Pat. No. 5,759,761 (Lushington et al.), U.S. Pat. No. 5,912,111 (Lok et al.), and U.S. Pat. No. 6,296,998 (Eikenberry et al), and EP 0 915 371 A1 (Lok et al.), all incorporated herein by reference.

Certain substituted or and unsubstituted thioureas can be used as chemical sensitizers including those described in U.S. Pat. No. 4,810,626 (Burgmaier et al.), U.S. Pat. No. 6,296,998 (Eikenberry et al.), U.S. Pat. No. 6,322,961 (Lam et al.), and U.S. Pat. No. 6,368,779 (Lynch et al.), all of the which are incorporated herein by reference.

Still other useful chemical sensitizers include tellurium- and selenium-containing compounds that are described in and U.S. Pat. No. 5,158,892 (Sasaki et al.), U.S. Pat. No. 5,238,807 (Sasaki et al.), U.S. Pat. No. 5,942,384 (Arai et al.), U.S. Pat. No. 6,620,577 (Lynch et al.), and U.S. Pat. No. 6,699,647 (Lynch et al.), all of which are incorporated herein by reference.

Noble metal sensitizers for use in the present invention include gold, platinum, palladium and iridium. Gold(I or III) sensitization is particularly preferred, and described in U.S. Pat. No. 5,759,761 (Lushington et al.) and U.S. Pat. No. 5,858,637 (Eshelman et al.). Combinations of gold(III) compounds and either sulfur- or tellurium-containing compounds are useful as chemical sensitizers and are described in U.S. Pat. No. 6,423,481 (Simpson et al.). All of the above references are incorporated herein by reference.

In addition, sulfur-containing compounds can be decomposed on silver halide grains in an oxidizing environment according to the teaching in U.S. Pat. No. 5,891,615 (Winslow et al.). Examples of sulfur-containing compounds that can be used in this fashion include sulfur-containing spectral sensitizing dyes. Other useful sulfur-containing chemical sensitizing compounds that can be decomposed in an oxidized environment are the diphenylphosphine sulfide compounds described in copending and commonly assigned U.S. Publication 2005/0123870 (Simpson et al.). Both the above patent and patent application are incorporated herein by reference.

The chemical sensitizers can be used in making the silver halide emulsions in conventional amounts that generally depend upon the average size of silver halide grains. Generally, the total amount is at least $10^{-10}$ mole per mole of total silver, and preferably from about $10^{-8}$ to about $10^{-2}$ mole per mole of total silver. The upper limit can vary depending upon the compound(s) used, the level of silver halide, and the average grain size and grain morphology.

Spectral Sensitizers

The photosensitive silver halides used in the photothermographic materials may be spectrally sensitized with one or more spectral sensitizing dyes that are known to enhance silver halide sensitivity to ultraviolet, visible, and/or infrared radiation of interest. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. They may be added at any stage in chemical finishing of the photothermographic emulsion, but are generally added after chemical sensitization. It is particularly useful that the photosensitive silver halides be spectrally sensitized to a wavelength of from about 300 to about 850 nm, preferably from about 300 to about 600 nm, more preferably to a wavelength of from about 300 to about 450 nm, even more preferably from a wavelength of from about 360 to 420 nm, and most preferably from a wavelength of from about 380 to about 420 nm. In other embodiments, the photosensitive silver halides are spectrally sensitized to a wavelength of from about 650 to about 1150 nm. A worker skilled in the art would know which dyes would provide the desired spectral sensitivity.

Suitable sensitizing dyes such as those described in U.S. Pat. No. 3,719,495 (Lea), U.S. Pat. No. 4,396,712 (Kinoshita et al.), U.S. Pat. No. 4,439,520 (Kofron et al.), U.S. Pat. No. 4,690,883 (Kubodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654 (Burrows et al), U.S. Pat. No. 5,441,866 (Miller et al.), U.S. Pat. No. 5,508,162 (Dankosh), U.S. Pat. No. 5,510,236 (Dankosh), and U.S. Pat. No. 5,541,054 (Miller et al.), and Japanese Kokai 2000-063690 (Tanaka et al.), 2000-112054 (Fukusaka et al.), 2000-273329 (Tanaka et al.), 2001-005145 (Arai), 2001-064527 (Oshiyama et al.), and 2001-154305 (Kita et al.), and *Research Disclosure*, item 308119, Section IV, December 1989. All of these publications are incorporated herein by reference.

Teachings relating to specific combinations of spectral sensitizing dyes also provided in U.S. Pat. No. 4,581,329 (Sugimoto et al.), U.S. Pat. No. 4,582,786 (Ikeda et al.), U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.), all of which are incorporated herein by reference.

Also useful are spectral sensitizing dyes that decolorize by the action of light or heat as described in U.S. Pat. No. 4,524,128 (Edwards et al.) and Japanese Kokai 2001-109101 (Adachi), 2001-154305 (Kita et al.), and 2001-183770 (Hanyu et al.), all of which are incorporated herein by reference.

Dyes may be selected for the purpose of supersensitization to attain much higher sensitivity than the sum of sensitivities that can be achieved by using each dye alone.

An appropriate amount of spectral sensitizing dye added is generally about $10^{-10}$ to $10^{-1}$ mole, and preferably, from about $10^{-7}$ to $10^{-2}$ mole per mole of silver halide.

Non-Photosensitive Source of Reducible Silver Ions

The non-photosensitive source of reducible silver ions in the photothermographic materials is a silver-organic compound that contains reducible silver(I) ions. Such compounds are generally silver salts of silver organic coordinating ligands that are comparatively stable to light and form a silver image when heated to 50° C. or higher in the presence of an exposed photocatalyst and a reducing agent composition.

Organic silver salts that are particularly useful in aqueous based photothermographic materials include silver salts of compounds containing an imino group. Such salts include, but are not limited to, silver salts of benzotriazole and substituted derivatives thereof (for example, silver methylbenzotriazole and silver 5-chlorobenzotriazole), silver salts of nitrogen acids selected from the group consisting of imidazole, pyrazole, 1,2,4-triazole and 1H-tetrazole, nitrogen acids or combinations thereof, as described in U.S. Pat. No. 4,220,709 (deMauriac). Also included are the silver salts of imidazole and imidazole derivatives as described in U.S. Pat. No. 4,260,677 (Winslow et al.). Both of these patents are incorporated herein by reference. A nitrogen acid as described herein is intended to include those compounds that have the moiety —NH— in the heterocyclic nucleus. Particularly useful silver salts are the silver salts of benzotriazole, substituted derivatives thereof, or mixtures of two or more of these salts. A silver salt of benzotriazole is most preferred.

Useful nitrogen-containing organic silver salts and methods of preparing them are also described in U.S. Pat. No. 6,977,139 (Zou et al.) that is incorporated herein by reference. Such silver salts (particularly the silver benzotriazoles) are rod-like in shape and have an average aspect ratio of at least 3:1 and a width index for particle diameter of 1.25 or less. Silver salt particle length is generally less than 1 μm. Also useful are the silver salt-toner co-precipitated nanocrystals comprising a silver salt of a nitrogen-containing heterocyclic compound containing an imino group, and a silver salt comprising a silver salt of a mercaptotriazole as described in copending and commonly assigned U.S. Ser. No. 10/935,384 (filed Sep. 7, 2004 by Hasberg, Lynch, Chen-Ho, and Zou). Both of these patent applications are incorporated herein by reference.

Other organic silver salts that are useful in photothermographic materials are silver carboxylates (both aliphatic and aromatic carboxylates) The aliphatic carboxylic acids generally have aliphatic chains that contain 10 to 30. Silver salts of long-chain aliphatic carboxylic acids having 15 to 28 carbon atoms are particularly preferred. Examples of such preferred silver salts include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Most preferably, at least silver behenate is used alone or in mixtures with other silver carboxylates. Silver carboxylates are particularly useful in organic solvent-based and aqueous latex-based photothermographic materials.

It is also convenient to use silver half soaps such as an equimolar blend of silver carboxylate and carboxylic acid that analyzes for about 14.5% by weight solids of silver in the blend and that is prepared by precipitation from an aqueous solution of an ammonium or an alkali metal salt of a commercially available fatty carboxylic acid, or by addition of the free fatty acid to the silver soap.

The methods used for making silver soap emulsions are well known in the art and are disclosed in *Research Disclosure*, item 22812, April 1983, *Research Disclosure*, item 23419, October 1983, U.S. Pat. No. 3,985,565 (Gabrielsen et al.) and the references cited above.

While the noted organic silver salts are the predominant silver salts in the materials, secondary organic silver salts can be used if present in "minor" amounts (less than 40 mol % based on the total moles of organic silver salts).

Such secondary organic silver salts include silver salts of heterocyclic compounds containing mercapto or thione groups and derivatives thereof such as silver triazoles, oxazoles, thiazoles, thiazolines, imidazoles, diazoles, pyridines, and triazines as described in U.S. Pat. No. 4,123,274 (Knight et al.) and U.S. Pat. No. 3,785,830 (Sullivan et al.). Also included are silver salts of aliphatic carboxylic acids containing a thioether group as described in U.S. Pat. No. 3,330,663 (Weyde et al.), soluble silver carboxylates comprising hydrocarbon chains incorporating ether or thioether linkages or sterically hindered substitution in the α- (on a hydrocarbon group) or ortho- (on an aromatic group) position as described in U.S. Pat. No. 5,491,059 (Whitcomb), silver salts of dicarboxylic acids, silver salts of sulfonates as described in U.S. Pat. No. 4,504,575 (Lee), silver salts of sulfosuccinates as described in EP 0 227 141A1 (Leenders et al.), silver salts of aromatic carboxylic acids (such as silver benzoate), silver salts of acetylenes as described, for example in U.S. Pat. No. 4,761,361 (Ozaki et al.) and U.S. Pat. No. 4,775,613 (Hirai et al.). Examples of other useful silver salts of mercapto or thione substituted compounds that do not contain a heterocyclic nucleus include silver salts of thioglycolic acids, dithiocarboxylic acids, and thioamides Sources of non-photosensitive reducible silver ions can also be in the form of core-shell silver salts as described in U.S. Pat. No. 6,355,408 (Whitcomb et al.), or the silver dimer compounds that comprise two different silver salts as described in U.S. Pat. No. 6,472,131 (Whitcomb), both references being incorporated herein by reference.

Still other useful sources of non-photosensitive reducible silver ions are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in U.S. Pat. No. 6,802,177 (Bokhonov et al.) that is incorporated herein by reference.

The one or more non-photosensitive sources of reducible silver ions (both primary and secondary organic silver salts) are preferably present in a total amount of about 5% by weight to about 70% by weight, and more preferably, about 10% to about 50% by weight, based on the total dry weight of the emulsion layers. Alternatively, the total amount of reducible silver ions is generally present in an amount of from about 0.001 to about 0.2 mol/m$^2$ of the dry photothermographic material (preferably from about 0.01 to about 0.05 mol/m$^2$).

The total amount of silver (from all silver sources) in the photothermographic materials is generally at least 0.002 mol/m$^2$ and preferably from about 0.01 to about 0.05 mol/m$^2$ for single-sided materials. For double-sided coated materials, total amount of silver from all sources would be doubled.

Reducing Agents

The reducing agent (or reducing agent composition comprising two or more components) for the source of reducible silver ions can be any material (preferably an organic material) that can reduce silver(I) ion to metallic silver. The "reducing agent" is sometimes called a "developer" or "developing agent."

When a silver benzotriazole silver source is used, ascorbic acid and reductone reducing agents are preferred. An "ascorbic acid" reducing agent means ascorbic acid, complexes, and derivatives thereof. Ascorbic acid reducing agents are described in a considerable number of publications including U.S. Pat. No. 5,236,816 (Purol et al.) and references cited therein.

Useful ascorbic acid developing agents include ascorbic acid and the analogues, isomers and derivatives thereof. Such compounds include, but are not limited to, D- or L-ascorbic acid, sugar-type derivatives thereof (such as sorboascorbic acid, γ-lactoascorbic acid, 6-desoxy-L-ascorbic acid, L-rhamno-ascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described in EP 0 573 700A1 (Lingier et al.), EP 0 585 792A1 (Passarella et al.), EP 0 588 408A1 (Hieronymus et al.), U.S. Pat. No. 2,688,549 (James et al.), U.S. Pat. No. 5,089,819 (Knapp), U.S. Pat. No. 5,278,035 (Knapp), U.S. Pat. No. 5,376,510 (Parker et al.), U.S. Pat. No. 5,384,232 (Bishop et al.), and U.S. Pat. No. 5,498,511 (Yamashita et al.), Japanese Kokai 7-56286 (Toyoda), and *Research Disclosure*, item 37152, March 1995. Mixtures of these developing agents can be used if desired.

Particularly useful reducing agents are ascorbic acid mono- or di-fatty acid esters such as the monolaurate, monomyristate, monopalmitate, monostearate, monobehenate, diluarate, distearate, dipalmitate, dibehenate, and dimyristate derivatives of ascorbic acid as described in U.S. Pat. No. 3,832,186 (Masuda et al.) and U.S. Pat. No. 6,309,814 (Ito). Preferred ascorbic acid reducing agents and their methods of preparation are those described in U.S. Publication 2005/0164136 (Ramsden et al.) and U.S. Ser. No. 10/935,645 (filed on Sep. 7, 2004 by Brick, Ramsden, and Lynch), both of which are incorporated herein by reference. A preferred reducing agent is L-ascorbic acid 6-O-palmitate.

A "reductone" reducing agent means a class of unsaturated, di- or poly-enolic organic compounds which, by virtue of the arrangement of the enolic hydroxy groups with respect to the unsaturated linkages, possess characteristic strong reducing power. The parent compound, "reductone" is 3-hydroxy-2-oxo-propionaldehyde (enol form) and has the structure HOCH═CH(OH)—CHO. Examples of reductone reducing agents can be found in U.S. Pat. No. 2,691,589 (Henn et al), U.S. Pat. No. 3,615,440 (Bloom), U.S. Pat. No. 3,664,835 (Youngquist et al.), U.S. Pat. No. 3,672,896 (Gabrielson et al.), U.S. Pat. No. 3,690,872 (Gabrielson et al.), U.S. Pat. No. 3,816,137 (Gabrielson et al.), U.S. Pat. No. 4,371,603 (Bartels-Keith et al.), U.S. Pat. No. 5,712,081 (Andriesen et al.), and U.S. Pat. No. 5,427,905 (Freedman et al.), all of which references are incorporated herein by reference.

When a silver carboxylate silver source is used in a photothermographic material, one or more hindered phenol reducing agents are preferred. In some instances, the reducing agent composition comprises two or more components such as a hindered phenol developer and a co-developer that can be chosen from the various classes of co-developers and reducing agents described below. Ternary developer mixtures involving the further addition of contrast enhancing agents are also useful. Such contrast enhancing agents can be chosen from the various classes of reducing agents described below.

"Hindered phenol reducing agents" are compounds that contain only one hydroxy group on a given phenyl ring and have at least one additional substituent located ortho to the hydroxy group.

One type of hindered phenol reducing agent includes hindered phenols and hindered naphthols.

Another type of hindered phenol reducing agent are hindered bis-phenols. These compounds contain more than one hydroxy group each of which is located on a different phenyl ring. This type of hindered phenol includes, for example, binaphthols (that is dihydroxybinaphthyls), biphenols (that is dihydroxybiphenyls), bis(hydroxynaphthyl) methanes, bis(hydroxyphenyl)-methanes bis(hydroxyphenyl)ethers, bis(hydroxyphenyl)sulfones, and bis (hydroxyphenyl)thioethers, each of which may have additional substituents.

Preferred hindered phenol reducing agents are bis(hydroxy-phenyl)methanes such as, bis(2-hydroxy-3-t-butyl-5-methylphenyl)methane (CAO-5), 1,1'-bis(2-hydroxy-3,5-dimethylphenyl)-3,5,5-trimethylhexane (NONOX® or PERMANAX WSO), and 1,1'-bis(2-hydroxy-3,5-dimethylphenyl)-isobutane (LOWINOX® 221B46) Mixtures of hindered phenol reducing agents can be used if desired.

An additional class of reducing agents that can be used includes substituted hydrazines including the sulfonyl hydrazides described in U.S. Pat. No. 5,464,738 (Lynch et al.). Still other useful reducing agents are described in U.S. Pat. No. 3,074,809 (Owen), U.S. Pat. No. 3,080,254 (Grant, Jr.), U.S. Pat. No. 3,094,417 (Workman), U.S. Pat. No. 3,887,417 (Klein et al.), and U.S. Pat. No. 5,981,151 (Leenders et al.). All of these patents are incorporated herein by reference.

Additional reducing agents that may be used include amidoximes, azines, a combination of aliphatic carboxylic acid aryl hydrazides and ascorbic acid, a reductone and/or a hydrazine, piperidinohexose reductone or formyl-4-methylphenylhydrazine, hydroxamic acids, a combination of azines and sulfonamidophenols, α-cyanophenylacetic acid derivatives, reductones, indane-1,3-diones, chromans, 1,4-dihydropyridines, and 3-pyrazolidones.

Useful co-developer reducing agents can also be used as described in U.S. Pat. No. 5,496,695 (Simpson et al.), U.S. Pat. No. 5,545,515 (Murray et al.), U.S. Pat. No. 5,635,339 (Murray), U.S. Pat. No. 5,654,130 (Murray), U.S. Pat. No. 5,705,324 (Murray), and U.S. Pat. No. 6,100,022 (Inoue et al.), and U.S. Pat. No. 6,387,605 (Lynch et al.), all of which are incorporated herein by reference.

Various contrast enhancing agents can be used in some photothermographic materials with specific co-developers. Examples of useful contrast enhancing agents include, but are not limited to, hydroxylamines, hydroxyamine acid compounds, N-acylhydrazine compounds, hydrogen atom donor compounds, alkanolamines and ammonium phthalamate compounds as described in U.S. Pat. No. 5,545,505 (Simpson), U.S. Pat. No. 5,545,507 (Simpson et al.), U.S. Pat. No. 5,558,983 (Simpson et al.), and U.S. Pat. No. 5,637,449 (Harring et al.), all of which are incorporated herein by reference.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Co-developers may be present generally in an amount of from about 0.001% to about 1.5% (dry weight) of the emulsion layer coating.

Halogen Substituted Tetraazaindene Compounds

One or more halogen-substituted tetraazaindene compounds are present in one or more layers on the imaging side(s) of the photothermographic materials. Thus, these compounds can be in the photothermographic layer, protective layer, or underlying "carrier" layer if present on one or both sides of the support. Where the materials are duplitized, the halogen-substituted tetraazaindene compounds can be on one or both imaging sides of the support and they can be the same or different compounds if present on both sides of the support. Preferably, the same halogen-substituted tetraazaindene compound is present on both sides of duplitized materials. Mixtures of the halogen-substituted tetraazaindene compounds can be used on one or both sides of the support. The noted halogen-substituted tetraazaindene compounds can be incorporated directly into the layers in which they are used upon drying, or they can be incorporated into layers from which they diffuse into adjacent layers (for example, from a protective overcoat into an imaging or emulsion layer).

The halogen-substituted tetraazaindene compounds can be represented by the following Structure (I):

(I)

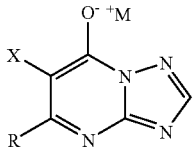

wherein R is hydrogen or a substituted or unsubstituted, linear or branched, alkyl group having 1 to 20 carbon atoms (and including alkaryl groups), a substituted or unsubstituted aryl group having 6 to 10 carbon atoms in the ring (such as substituted or unsubstituted phenyl and naphthyl groups), or substituted or unsubstituted cycloalkyl groups having 5 to 10 carbon atoms in the ring system. Preferably, R is a substituted or unsubstituted alkyl group, and more preferably, it is a substituted or unsubstituted alkyl group having 1 to 4 carbon atoms. Useful substituents for these groups include alkyloxy, alkylthio, cyanoalkyl, and haloalkyl, and others readily apparent to one skilled in the art.

X is a fluoro, chloro, or bromo group, and $M^+$ is hydrogen or an alkali metal or ammonium ion.

Representative $M^+$ ions are hydrogen, alkali metal ions such as $Li^+$, $Na^+$, $K^+$, $Rb^+$, and $Cs^+$, and ammonium ions such as ammonium, alkyl ammonium, dialkylammonium, and tetraalkylammonium ions where the alkyl groups have from 1 to 10 carbon atoms. It is preferred that $M^+$ be hydrogen, $Li^+$, $Na^+$, or $K^+$. It is also preferred that X is chloro or bromo, and most preferably, X is bromo.

The halogen-substituted tetraazaindene compounds described herein are prepared by the condensation of an appropriately substituted ethylacetoacetate with a 3-amino-1,2,4-triazole. Acetic acid is the preferred solvent for this reaction and generally heating is required for the reaction to progress. Depending on the nature of the substituents on the ethyl acetoacetate, reaction is usually complete in from few minutes to few hours. Electron-withdrawing groups such as halogen and cyano shorten the reaction time. Preparation of tetraazaindene compounds is also described for example in U.S. Pat. No. 2,933,388 (Knott), Japan Kokai 55-051089 (Onishi et al.), and J. J. Hlavka et al., *J. Heterocyclic Chemistry,* 1985, 22(5), 1317–22. Appropriately-substituted tetraazaindene compounds can also be obtained from various commercial sources such as Aldrich Chemical Company. Representative synthetic methods for preparing certain compounds useful in this invention are described below with the Examples.

Representative useful halogen-substituted tetraazaindene compounds are the following compounds TAI-1 through TAI-14:

(TAI-1)

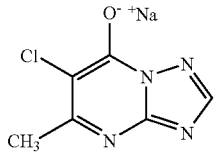

(TAI-2)

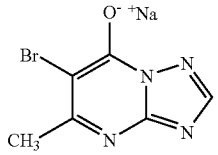

(TAI-3)

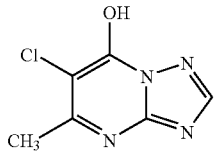

(TAI-4)

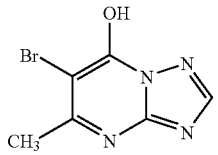

(TAI-5)

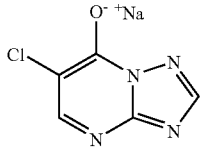

(TAI-6)

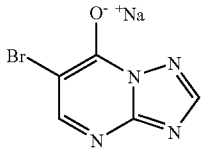

(TAI-7)

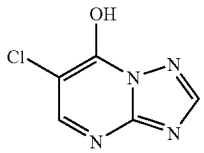

(TAI-8)

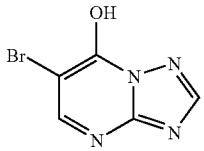

(TAI-9)

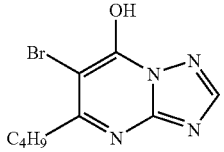

(TAI-10)

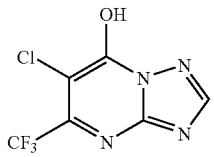

-continued (TAI-11)

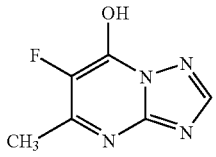

(TAI-12)

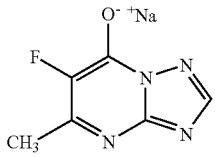

(TAI-13)

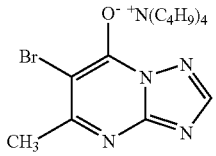

(TAI-14)

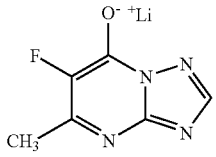

Preferred halogen-substituted tetraazaindene compounds include Compounds TAI-1, TAI-2, TAI-3, TAI-4, TAI-11 and TAI-12. Compounds TAI-1, TAI-2, TAI-3, and TAI-4 are most preferred.

The halogen-substituted tetraazaindene compound(s) are present in an amount of at least 0.00002 mol/$m^2$ and preferably from about 0.0001 to about 0.001 mol/$m^2$.

Other Addenda

The photothermographic materials can also contain other additives where appropriate, such as additional shelf-life stabilizers and speed enhancing agents, antifoggants, contrast enhancing agents, toners, development accelerators, acutance dyes, post-processing stabilizers or stabilizer precursors, thermal solvents (also known as melt formers), humectants, and other image-modifying agents as would be readily apparent to one skilled in the art.

Toners are compounds that when added to the imaging layer shift the color of the developed silver image from yellowish-orange to brown-black or blue-black, and/or act as development accelerators to speed up thermal development. "Toners" or derivatives thereof that improve the black-and-white image are highly desirable components of the photothermographic materials.

Thus, compounds that either act as toners or react with a reducing agent to provide toners can be present in an amount of about 0.01% by weight to about 10% (preferably from about 0.1% to about 10% by weight) based on the total dry weight of the layer in which they are included. The amount can also be defined as being within the range of from about $1\times10^{-5}$ to about 1.0 mol per mole of non-photosensitive source of reducible silver in the photothermographic material. The toner compounds may be incorporated in one or more of the photothermographic layers as well as in adjacent layers such as the outermost protective layer or underlying "carrier" layer. Toners can be located on both sides of the support if photothermographic layers are present on both sides of the support.

Compounds useful as toners are described in U.S. Pat. No. 3,074,809 (Owen), U.S. Pat. No. 3,080,254 (Grant, Jr.), U.S. Pat. No. 3,446,648 (Workman), U.S. Pat. No. 3,844,797 (Willems et al.), U.S. Pat. No. 3,847,612 (Winslow), U.S. Pat. No. 3,951,660 (Hagemann et al.), U.S. Pat. No. 4,082,901 (Laridon et al.), U.S. Pat. No. 4,123,282 (Winslow), U.S. Pat. No. 5,599,647 (Defieuw et al.), and U.S. Pat. No. 3,832,186 (Masuda et al.), and GB 1,439,478 (AGFA).

Particularly useful toners are mercaptotriazoles as described in U.S. Pat. No. 6,713,240 (Lynch et al.), the heterocyclic disulfide compounds described in U.S. Pat. No. 6,737,227 (Lynch et al.), the triazine-thione compounds described in U.S. Pat. No. 6,703,191 (Lynch et al.), and the silver salt-toner co-precipitated nano-crystals described in copending and commonly assigned U.S. Ser. No. 10/935,384 (noted above). All of the above are incorporated herein by reference.

Also useful as toners are phthalazine and phthalazine derivatives [such as those described in U.S. Pat. No. 6,146,822 (Asanuma et al.) incorporated herein by reference], phthalazinone, and phthalazinone derivatives as well as phthalazinium compounds [such as those described in U.S. Pat. No. 6,605,418 (Ramsden et al.), incorporated herein by reference].

To further control the properties of photothermographic materials, (for example, supersensitization, contrast, $D_{min}$, speed, or fog), it may be preferable to add one or more heteroaromatic mercapto compounds or heteroaromatic disulfide compounds of the formulae Ar—S-$M^1$ and Ar—S—S—Ar, wherein $M^1$ represents a hydrogen atom or an alkali metal atom and Ar represents a heteroaromatic ring or fused heteroaromatic ring containing one or more of nitrogen, sulfur, oxygen, selenium, or tellurium atoms. Useful heteroaromatic mercapto compounds are described as supersensitizers in EP 0 559 228 B1 (Philip Jr. et al.).

The photothermographic materials can be further protected against the production of fog and can be stabilized against loss of sensitivity during storage. Suitable additional antifoggants and stabilizers that can be used alone or in combination include thiazolium salts as described in U.S. Pat. No. 2,131,038 (Brooker et al.) and U.S. Pat. No. 2,694,716 (Allen), azaindenes as described in U.S. Pat. No. 2,886,437 (Piper), triazaindolizines as described in U.S. Pat. No. 2,444,605 (Heimbach), urazoles as described in U.S. Pat. No. 3,287,135 (Anderson), sulfocatechols as described in U.S. Pat. No. 3,235,652 (Kennard), oximes as described in GB 623,448 (Carrol et al.), polyvalent metal salts as described in U.S. Pat. No. 2,839,405 (Jones), and thiuronium salts as described in U.S. Pat. No. 3,220,839 (Herz).

The photothermographic materials may also include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds. Particularly useful antifoggants of this type are polyhalo antifoggants, such as those having a —$SO_2C(X')_3$ group wherein X' represents the same or different halogen atoms. Compounds having —$SO_2CBr_3$ groups are particularly preferred. Such compounds are described, for example, in U.S. Pat. No. 5,369,000 (Sakizadeh et al.), U.S. Pat. No. 5,460,938 (Kirk et al.), U.S. Pat. No. 5,464,737 (Sakizadeh et al.), U.S. Pat. No. 5,594,143 (Kirk et al.), and U.S. Pat. No. 5,374,514 (Kirk et al.).

Another class of useful antifoggants includes those compounds described in U.S. Pat. No. 6,514,678 (Burgmaier et al.), incorporated herein by reference.

Advantageously, the thermally developable materials also include one or more thermal solvents (also called "heat solvents," "thermosolvents," "melt formers," "melt modifiers," "eutectic formers," "development modifiers," "waxes," or "plasticizers"). By the term "thermal solvent" is meant an organic material that becomes a plasticizer or liquid solvent for at least one of the imaging layers upon heating at a temperature above 60° C. Representative examples of such compounds include polyethylene glycols having a mean molecular weight in the range of 1,500 to 20,000, ethylene carbonate, niacinamide, hydantoin, 5,5-dimethylhydantoin, salicylanilide, succinimide, N-hydroxy-succinimide, phthalimide, N-potassium-phthalimide, N-hydroxyphthalimide, N-hydroxy-1,8-naphthalimide, phthalazine, 1-(2H)-phthalazinone, 2-acetylphthalazinone, benzanilide, urea, 1,3-dimethylurea, 1,3-diethylurea, 1,3-diallylurea, xylitol, meso-erythritol, D-sorbitol, neopentyl glycol, 1,1,1-tris(hydroxymethyl)ethane, pentaerythritol, trimethylolpropane, tetrahydro-2-pyrimidone, glycouril, 2-imidazolidone, 2-imidazolidone-4-carboxylic acid, methyl sulfonamide, and benzenesulfonamide. Combinations of these compounds can also be used including, for example, a combination of succinimide and 1,3-dimethylurea. Known thermal solvents are disclosed, for example, in U.S. Pat. No. 3,347,675 (Henn et al.), U.S. Pat. No. 3,438,776 (Yudelson), U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender), and in *Research Disclosure*, December 1976, item 15027. All of these are incorporated herein by reference.

Preferred thermal solvents are polyhydroxy alkanes containing 4-, 5-, and 6-carbon atoms. Many of these are reduced sugars or "sugar-like" molecules. Xylitol, pentaerythritol, D-sorbitol, trimethylolpropane, and 1,1,1-tris (hydroxymethyl)ethane, are particularly preferred thermal solvents.

It may be advantageous to include a base-release agent or base precursor in the photothermographic materials. Representative base-release agents or base precursors include guanidinium compounds, such as guanidinium trichloroacetate, and other compounds that are known to release a base but do not adversely affect photographic silver halide materials, such as phenylsulfonyl acetates as described in U.S. Pat. No. 4,123,274 (Knight et al.).

Phosphors

In some embodiments, it is also effective to incorporate X-radiation-sensitive phosphors in the photothermographic materials as described in U.S. Pat. No. 6,573,033 (Simpson et al.) and U.S. Pat. No. 6,440,649 (Simpson et al.), both of which are incorporated herein by reference. Other useful phosphors are primarily "activated" phosphors known as phosphate phosphors and borate phosphors. Examples of these phosphors are rare earth phosphates, yttrium phosphates, strontium phosphates, or strontium fluoroborates (including cerium activated rare earth or yttrium phosphates, or europium activated strontium fluoroborates) as described in U.S. Ser. No. 10/826,500 (filed Apr. 16, 2004 by Simpson, Sieber, and Hansen).

The one or more phosphors used in the practice of this invention are present in the photothermographic materials in an amount of at least 0.1 mole per mole per mole of total silver in the photothermographic material.

Binders

The photosensitive silver halide, the non-photosensitive source of reducible silver ions, the reducing agent, antifoggant(s), and any other additives used in the present invention are added to and coated in one or more binders using a suitable aqueous solvent. Thus, aqueous-based formulations are used to prepare the photothermographic materials. Mixtures of different types of hydrophilic and/or hydrophobic binders can also be used. Preferably, hydrophilic polymer binders and water-dispersible polymeric latexes are used to provide aqueous-based formulations and photothermographic materials.

Examples of useful hydrophilic polymer binders include, but are not limited to, proteins and protein derivatives, gelatin and gelatin derivatives (hardened or unhardened), cellulosic materials, acrylamide/methacrylamide polymers, acrylic/methacrylic polymers, polyvinyl pyrrolidones, polyvinyl alcohols, polyvinyl lactams, polymers of sulfoalkyl acrylate or methacrylates, hydrolyzed polyvinyl acetates, polyamides, polysaccharides, and other naturally occurring or synthetic vehicles commonly known for use in aqueous-based photographic emulsions (see for example *Research Disclosure*, item 38957, noted above).

Particularly useful hydrophilic polymer binders are gelatin, gelatin derivatives, polyvinyl alcohols, and cellulosic materials. Gelatin and its derivatives are most preferred, and comprise at least 75 weight % of total binders when a mixture of binders is used.

Aqueous dispersions of water-dispersible polymeric latexes may also be used, alone or with hydrophilic or hydrophobic binders described herein. Such dispersions are described in, for example, U.S. Pat. No. 4,504,575 (Lee), U.S. Pat. No. 6,083,680 (Ito et al), U.S. Pat. No. 6,100,022 (Inoue et al.), U.S. Pat. No. 6,132,949 (Fujita et al.), U.S. Pat. No. 6,132,950 (Ishigaki et al.), U.S. Pat. No. 6,140,038 (Ishizuka et al.), U.S. Pat. No. 6,150,084 (Ito et al.), U.S. Pat. No. 6,312,885 (Fujita et al.), and U.S. Pat. No. 6,423,487 (Naoi), all of which are incorporated herein by reference.

Minor amounts (less than 50 weight % based on total binder weight) of hydrophobic binders (not in latex form) may also be used. Examples of typical hydrophobic binders include polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. The polyvinyl acetals (such as polyvinyl butyral and polyvinyl formal), cellulose ester polymers, and vinyl copolymers (such as polyvinyl acetate and polyvinyl chloride) are preferred. Particularly suitable binders are polyvinyl butyral resins that are available under the name BUTVAR1 from Solutia, Inc. (St. Louis, Mo.) and PIOLOFORM® from Wacker Chemical Company (Adrian, Mich.) and cellulose ester polymers.

Hardeners for various binders may be present if desired. Useful hardeners are well known and include diisocyanates as described for example, in EP 0 600 586B1 (Philip, Jr. et al.) and vinyl sulfone compounds as described in U.S. Pat. No. 6,143,487 (Philip, Jr. et al.), and EP 0 640 589A1 (Gathmann et al.), aldehydes and various other hardeners as described in U.S. Pat. No. 6,190,822 (Dickerson et al.).

Where the proportions and activities of the photothermographic materials require a particular developing time and temperature, the binder(s) should be able to withstand those conditions. Generally, it is preferred that the binder does not decompose or lose its structural integrity at 120° C. for 60 seconds. It is more preferred that it does not decompose or lose its structural integrity at 177° C. for 60 seconds.

The binder(s) is used in an amount sufficient to carry the components dispersed therein. Preferably, a binder is used at a level of about 10% by weight to about 90% by weight, and more preferably at a level of about 20% by weight to about 70% by weight, based on the total dry weight of the layer in which it is included. The amount of binders on opposing sides of the support in double-sided materials may be the same or different.

Support Materials

The photothermographic materials comprise a polymeric support that is preferably a flexible, transparent film that has any desired thickness and is composed of one or more polymeric materials. They are required to exhibit dimensional stability during thermal development and to have suitable adhesive properties with overlying layers. Useful polymeric materials for making such supports include, but are not limited to, polyesters, cellulose acetate and other cellulose esters, polyvinyl acetal, polyolefins, polycarbonates, and polystyrenes. Preferred supports are composed of polymers having good heat stability, such as polyesters and polycarbonates. Polyethylene terephthalate film is a particularly preferred support. Support materials may also be treated or annealed to reduce shrinkage and promote dimensional stability.

It is also useful to use supports comprising transparent, multilayer, polymeric supports comprising numerous alternating layers of at least two different polymeric materials as described in U.S. Pat. No. 6,630,283 (Simpson et al.). Dichroic mirror layers as described in U.S. Pat. No. 5,795,708 (Boutet) can also be used. Both of the above patents are incorporated herein by reference.

Support materials can contain various colorants, pigments, antihalation or acutance dyes if desired. For example, blue-tinted supports are particularly useful for providing images useful for medical diagnosis. Support materials may be treated using conventional procedures (such as corona discharge) to improve adhesion of overlying layers, or subbing or other adhesion-promoting layers can be used.

Photothermographic Formulations and Constructions

The imaging components are prepared in a formulation containing a hydrophilic polymer binder (such as gelatin, a gelatin-derivative, or a cellulosic material) or a water-dispersible polymer in latex form in an aqueous solvent such as water or water-organic solvent mixtures to provide aqueous-based coating formulations. Thus, the photothermographic imaging layers on one or both sides of the support are prepared and coated out of aqueous formulations.

The photothermographic materials can contain plasticizers and lubricants such as poly(alcohols) and diols as described in U.S. Pat. No. 2,960,404 (Milton et al.), fatty acids or esters as described in U.S. Pat. No. 2,588,765 (Robijns) and U.S. Pat. No. 3,121,060 (Duane), and silicone resins as described in GB 955,061 (DuPont). The materials can also contain inorganic or organic matting agents as described in U.S. Pat. No. 2,992,101 (Jelley et al.) and U.S. Pat. No. 2,701,245 (Lynn). Polymeric fluorinated surfactants may also be useful in one or more layers as described in U.S. Pat. No. 5,468,603 (Kub).

U.S. Pat. No. 6,436,616 (Geisler et al.), incorporated herein by reference, describes various means of modifying photothermographic materials to reduce what is known as the "woodgrain" effect, or uneven optical density.

The photothermographic materials can include one or more antistatic agents in any of the layers on either or both sides of the support. Conductive components include soluble salts, evaporated metal layers, or ionic polymers as described in U.S. Pat. No. 2,861,056 (Minsk) and U.S. Pat. No. 3,206,312 (Sterman et al.), insoluble inorganic salts as described in U.S. Pat. No. 3,428,451 (Trevoy), polythiophenes as described in U.S. Pat. No. 5,747,412 (Leenders et al.), electroconductive underlayers as described in U.S. Pat. No. 5,310,640 (Markin et al.), electronically-conductive metal antimonate particles as described in U.S. Pat. No. 5,368,995 (Christian et al.), and electrically-conductive metal-containing particles dispersed in a polymeric binder as described in EP 0 678 776 A1 (Melpolder et al.). Particularly useful conductive particles are the non-acicular metal antimonate particles described in U.S. Pat. No. 6,689,546 (LaBelle et al.), and in copending and commonly assigned U.S. Ser. No. 10/930,428 (filed Aug. 31, 2004 by Ludemann, LaBelle, Koestner, Hefley, Bhave, Geisler, and Philip), Ser. No. 10/930,438 (filed Aug. 31, 2004 by Ludemann, LaBelle, Philip, Koestener, and Bhave), and Ser. No. 10/978,205 (filed Oct. 29, 2004 by Ludemann, LaBelle, Koestner, and Chen). All of the above patents and patent applications are incorporated herein by reference.

In addition, fluorochemicals such as Fluorad® FC-135 (3M Corporation), ZONYL® FSN (E. I. DuPont de Nemours & Co.), as well as those described in U.S. Pat. No. 4,975,363 (Cavallo et al.), U.S. Pat. No. 5,674,671 (Brandon et al.), U.S. Pat. No. 6,171,707 (Gomez et al.), U.S. Pat. No. 6,287,754 (Melpolder et al.), U.S. Pat. No. 6,762,013 (Sakizadeh et al.), and U.S. Pat. No. 6,699,648 (Sakizadeh et al.) can be used. All of the above are incorporated herein by reference.

The photothermographic materials can have a protective overcoat layer (or outermost topcoat layer) disposed over the one or more imaging layers on one or both sides of the support. The binders for such overcoat layers can be any of the binders described in the Binders Section, but preferably, they are predominantly (over 50 weight %) hydrophilic binders or water-dispersible polymer latex binders. More preferably, the protective layers include gelatin or a gelatin derivative as the predominant binder(s) especially when the one or more imaging layers also include gelatin or a gelatin derivative as the predominant binder(s).

For double-sided photothermographic materials, each side of the support can include one or more of the same or different imaging layers, interlayers, and protective overcoat layers. In such materials preferably a overcoat is present as the outermost layer on both sides of the support. The photothermographic layers on opposite sides can have the same or different construction and can be overcoated with the same or different protective layers Layers to promote adhesion of one layer to another are also known, as described in U.S. Pat. No. 4,741,992 (Przezdziecki), U.S. Pat. No. 5,804,365 (Bauer et al.), and U.S. Pat. No. 5,891,610 (Bauer et al.). Adhesion can also be promoted using specific polymeric adhesive materials as described for example in U.S. Pat. No. 5,928,857 (Geisler et al.).

The formulations described herein (including the photothermographic formulations) can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Koepke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), and U.S. Pat. No. 5,861,195 (Bhave et al.), and GB 837,095 (Ilford). A typical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

Simultaneously with or subsequently to application of an emulsion formulation to the support, a protective overcoat formulation can be applied over the emulsion formulation.

Preferably, two or more layer formulations are applied simultaneously to a film support using slide coating techniques, an overcoat layer being coated on top of a photothermographic layer while the photothermographic layer is still wet.

In other embodiments, a "carrier" layer formulation comprising a single-phase mixture of the two or more polymers may be applied directly onto the support and thereby located underneath the photothermographic emulsion layer(s) as described in U.S. Pat. No. 6,355,405 (Ludemann et al.), incorporated herein by reference. The carrier layer formulation can be applied simultaneously with application of the emulsion layer formulation and any overcoat formulations.

Mottle and other surface anomalies can be reduced in the materials by incorporation of a fluorinated polymer as described in U.S. Pat. No. 5,532,121 (Yonkoski et al.) or by using particular drying techniques as described in U.S. Pat. No. 5,621,983 (Ludemann et al.).

While the overcoat and photothermographic layers can be coated on one side of the film support, manufacturing methods can also include forming on the opposing or backside of the polymeric support, one or more additional layers, including a conductive layer, antihalation layer, or a layer containing a matting agent (such as silica), or a combination of such layers. Alternatively, one backside layer can perform all of the desired functions.

The photothermographic materials may also usefully include a magnetic recording material as described in *Research Disclosure*, Item 34390, November 1992, or a transparent magnetic recording layer such as a layer containing magnetic particles on the underside of a transparent support as described in U.S. Pat. No. 4,302,523 (Audran et al.).

To promote image sharpness, photothermographic materials can contain one or more layers containing acutance and/or antihalation dyes that are chosen to have absorption close to the exposure wavelength and are designed to absorb scattered light. One or more antihalation compositions may be incorporated into one or more antihalation backing layers, antihalation underlayers, or as antihalation overcoats.

Dyes useful as antihalation and acutance dyes include squaraine dyes described in U.S. Pat. No. 5,380,635 (Gomez et al.) and U.S. Pat. No. 6,063,560 (Suzuki et al.), and EP 1 083 459A1 (Kimura), indolenine dyes described in EP 0 342 810A1 (Leichter), and cyanine dyes described in U.S. Pat. No. 6,689,547 (Hunt et al.), all incorporated herein by reference.

It may also be useful to employ compositions including acutance or antihalation dyes that will decolorize or bleach with heat during processing, as described in U.S. Pat. No. 5,135,842 (Kitchin et al.), U.S. Pat. No. 5,266,452 (Kitchin et al.), U.S. Pat. No. 5,314,795 (Helland et al.), and U.S. Pat. No. 6,306,566, (Sakurada et al.), and Japanese Kokai 2001-142175 (Hanyu et al.) and 2001-183770 (Hanye et al.). Useful bleaching compositions are also described in Japanese Kokai 11-302550 (Fujiwara), 2001-109101 (Adachi), 2001-51371 (Yabuki et al.), and 2000-029168 (Noro). All of the noted publications are incorporated herein by reference.

Other useful heat-bleachable backside antihalation compositions can include an infrared radiation absorbing compound such as an oxonol dye or other compounds used in combination with a hexaarylbiimidazole (also known as a "HABI"), or mixtures thereof. HABI compounds are described in U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described for example in U.S. Pat. No. 6,455,210 (Irving et al.), U.S. Pat. No. 6,514,677 (Ramsden et al.), and U.S. Pat. No. 6,558,880 (Goswami et al.), all incorporated herein by reference.

Under practical conditions of use, these compositions are heated to provide bleaching at a temperature of at least 90° C. for at least 0.5 seconds (preferably, at a temperature of from about 100° C. to about 200° C. for from about 5 to about 20 seconds).

Imaging/Development

The photothermographic materials can be imaged in any suitable manner consistent with the type of material, using any suitable imaging source (typically some type of radiation or electronic signal). In some embodiments, the materials are sensitive to radiation in the range of from about at least 100 nm to about 1400 nm, and normally from about 300 nm to about 850 nm (preferably from about 300 to about 600 nm, more preferably from about 300 to about 450 nm, even more preferably from a wavelength of from about 360 to 420 nm, and most preferably from about 380 to about 420 nm), using appropriate spectral sensitizing dyes.

Imaging can be achieved by exposing the photothermographic materials to a suitable source of radiation to which they are sensitive, including ultraviolet radiation, visible light, near infrared radiation, and infrared radiation to provide a latent image. Suitable exposure means are well known and include incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art such as described in *Research Disclosure*, item 38957 (noted above).

The photothermographic materials can be indirectly imaged using an X-radiation imaging source and one or more prompt-emitting or storage X-ray sensitive phosphor screens adjacent to the photothermographic material. The phosphors emit suitable radiation to expose the photothermographic material. Preferred X-ray screens are those having phosphors emitting in the near ultraviolet region of the spectrum (from 300 to 400 nm), in the blue region of the spectrum (from 400 to 500 nm), and in the green region of the spectrum (from 500 to 600 nm).

In other embodiments, the photothermographic materials can be imaged directly using an X-radiation imaging source to provide a latent image.

Thermal development conditions will vary, depending on the construction used but will typically involve heating the photothermographic material at a suitably elevated temperature, for example, at from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means. A preferred heat development procedure for photothermographic materials includes heating at from 130° C. to about 165° C. for from about 3 to about 25 seconds. Thermal development of is carried out with the photothermographic material being in a substantially water-free environment and without application of any solvent to the material.

Imaging Assemblies

In some embodiments, the photothermographic materials are used or arranged in association with one or more phosphor intensifying screens and/or metal screens in what is known as "imaging assemblies." Double-sided visible light sensitive photothermographic materials are preferably used in combination with two adjacent intensifying screens, one screen in the "front" and one screen in the "back" of the material. The front and back screens can be appropriately chosen depending upon the type of emissions desired, the desired photicity, and emulsion speeds. The imaging assemblies can be prepared by arranging the photothermographic material and one or more phosphor intensifying screens in a suitable holder (often known as a cassette), and appropriately packaging them for transport and imaging uses.

There are a wide variety of phosphors known in the art that can be formulated into phosphor intensifying screens as described in hundreds of publications. U.S. Pat. No. 6,573,033 (noted above) describes phosphors that can be used in this manner. Particularly useful phosphors are those that emit radiation having a wavelength of from about 300 to about 450 nm and preferably radiation having a wavelength of from about 360 to about 420 nm.

Preferred phosphors useful in the phosphor intensifying screens include one or more alkaline earth fluorohalide phosphors and especially the rare earth activated (doped) alkaline earth fluorohalide phosphors. Particularly useful phosphor intensifying screens include a europium-doped barium fluorobromide ($BaFBr_2$:Eu) phosphor. Other useful phosphors are described in U.S. Pat. No. 6,682,868 (Dickerson et al.) and references cited therein, all incorporated herein by reference.

Use as a Photomask

In some embodiments, the photothermographic materials are sufficiently transmissive in the range of from about 350 to about 450 nm in non-imaged areas to allow their use in a method where there is a subsequent exposure of an ultraviolet or short wavelength visible radiation sensitive imageable medium. The heat-developed materials absorb ultraviolet or short wavelength visible radiation in the areas where there is a visible image and transmit ultraviolet or short wavelength visible radiation where there is no visible image. The materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate.

These embodiments of the imaging method of this invention are carried out using the following Steps (A) and (B) noted above and the following Steps (C) and (D):

(C) positioning the exposed and photothermographic material with the visible image therein between a source of imaging radiation and an imageable material that is sensitive to the imaging radiation, and (D) exposing the imageable material to the imaging radiation through the visible image in the exposed and photothermographic material to provide an image in the imageable material.

The following examples are provided to illustrate the practice of the present invention and the invention is not meant to be limited thereby.

Materials and Methods for the Examples:

All materials used in the following examples can be prepared using known synthetic procedures or are available from standard commercial sources, such as Aldrich Chemical Co. (Milwaukee, Wis.), unless otherwise specified. All percentages are by weight unless otherwise indicated. The following additional materials were prepared and used.

BYK-022 is a defoamer and is available from Byk-Chemie Corp. (Wallingford, Conn.).

SPP 3000 is an 88% hydrolyzed polyvinyl alcohol having a molecular weight of 3000. It is available from Scientific Polymer Products. (Ontario, N.Y.).

CELVOL® 203S is a polyvinyl alcohol (PVA) and is available from Celanese Corp. (Dallas, Tex.).

CELVOL® 603S is a polyvinyl alcohol (PVA) and is available from Celanese Corp. (Dallas, Tex.).

TRITON®X-114 is a nonionic surfactant that is available from Dow Chemical Corp. (Midland Mich.).

TRITON® X-200 is an anionic surfactant that is available from Dow Chemical Corp. (Midland Mich.).

ZONYL® FS-300 is a nonionic fluorosurfactant that is available from E. I. DuPont de Nemours & Co. (Wilmington, Del.).

BZT is benzotriazole. AgBZT is silver benzotriazole. NaBZT is the sodium salt of benzotriazole.

Compound SS-1a is described in U.S. Pat. No. 6,296,998 (Eikenberry et al.) and is believed to have the following structure:

(SS-1a)

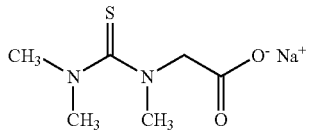

Compound D-1 is L-Ascorbic acid 6-O-palmitate and is available from Aceto Corp., (Lake Success, N.Y.). It is believed to have the following structure.

(D-1)

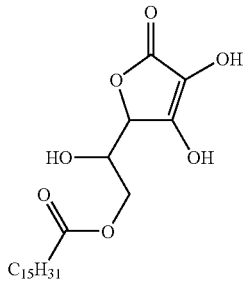

Compound A-1 is the reaction product of butyl chloride and phthalazine as described in U.S. Pat. No. 6,605,418 (Ramsden et al.) and is believed to have the following structure.

(A-1)

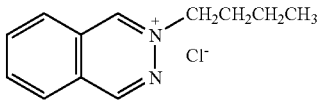

Bisvinyl sulfonyl methane (VS-1) is 1,1'(methylenebis (sulfonyl))-bis-ethene and is described in EP 0 640 589 A1 (Gathmann et al.). It is believed to have the following structure:

(VS-1)

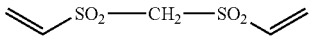

Compound S-1 is a 10:1 mixture of the compounds shown below.

(S-1)

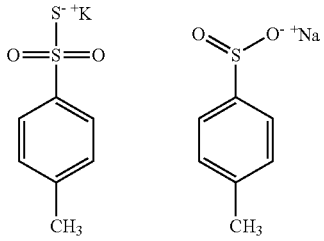

Compound PS-1 is S-octadecyl phenylcarbamothioate. It has the structure shown below and was prepared as described in copending and commonly assigned U.S. Ser. No. 11/025,633 (filed on Dec. 29, 2004 by Ramsden, Philip, Lynch, Chen-Ho, Ulrich, Sakizadeh, Leon, and Burgmaier) that is incorporated herein by reference.

(PS-1)

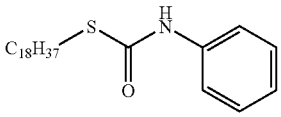

Compound T-1 is 2,4-dihydro-4-(phenylmethyl)-3H-1,2,4-triazole-3-thione. It is believed to have the structure shown below. It may also exist as the thione tautomer. The silver salt of this compound is referred to as AgT-1.

(T-1)

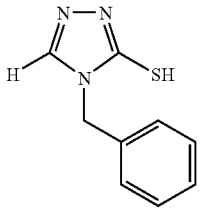

Blue sensitizing dye SSD-1 is believed to have the following structure.

(SSD-1)

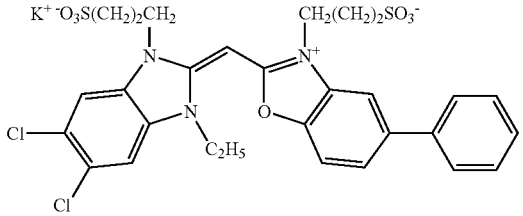

Gold sensitizer Compound GS-1 is believed to have the following structure.

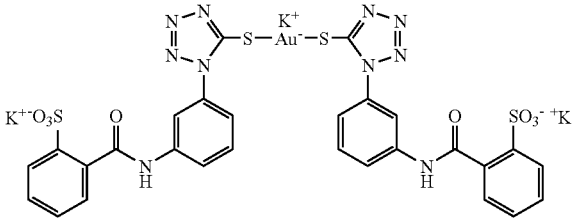

Comparative Compound TAI-C-1 is the sodium salt of 5-cyano-4-hydroxy-6-methyl-1,3,3a,7-tetraazaindene.

(TAI-C-1)

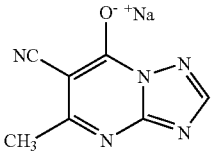

Comparative Compound TAI-C-2 is the sodium salt of 4-hydroxy-6-methyl-1,3,3a,7-tetraazaindene.

(TAI-C-2)

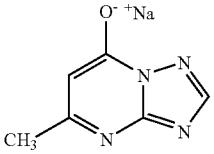

Preparation of 1,3,3a,7-Tetraazaindene Compounds

5-Chloro-4-hydroxy-6-methyl-1,3,3a,7-tetraazaindene—TAI-3

3-Amino-1,2,4-triazole (4.2 g, 0.05 mol) and ethyl-2-chloro-acetoacetate (12.64 g, 0.0768 mol) were refluxed in acetic acid (15 ml) under a nitrogen atmosphere. The reaction mixture first turned into a clear yellow solution and after about 15 minutes a solid started precipitating. Reflux continued for one hour. The crude product was filtered off, washed with hot methanol (2×10 ml), and dried in an oven at 90° C. to give 5.9 g (64%) of pure TAI-3. TLC (in $Et_2O$/MeOH, 70:30 v/v) showed only one spot. The compound is soluble in hot DMF and DMSO. mp=starts darkening at ~308° C. and decomposes at temperatures >325° C.

5-Bromo-4-hydroxy-6-methyl-1,3,3a,7-tetraazaindene—TAI-4

A suspension of 4-hydroxy-6-methyl-1,3,3a,7-tetraazaindene (15.0 g, 0.1 mol) in acetic acid (100 ml) was treated dropwise at 20° C. with a solution of bromine (16.172 g, 0.102 mol) in acetic acid (20 ml). As the reaction progressed, the suspended crystals dissolved and new crystals of brominated product were formed. After about 2 hours, the reaction mixture was poured into water (250 ml) and crystals were collected by filtration. The crude product was purified by first converting into its sodium salt by dissolving 22 g in one liter of hot aqueous 0.2N sodium carbonate and then slowly acidifying with dilute hydrochloric acid. The unchanged starting material was converted into a soluble salt by addition of excess of triethylamine. Crystals were then collected and recrystallized from hot water to give 19 g (82%) of Compound TAI-4 as white needles, m.p.=269° C.

5-Chloro-4-hydroxy-6-trifluoromethyl-1,3,3a,7-tetraazaindene—TAI-10

3-Amino-1,2,4-triazole (4.2 g, 0.05 mol) and ethyl-2-chloro-4,4,4-trifluoroacetoacetate (16.78 g, 0.0768 mol) were refluxed in acetic acid (15 ml) under a nitrogen atmosphere. A white precipitate started forming as soon as the amino-triazole dissolved in the solution and the reaction was completed in few minutes (electron-withdrawing groups enhance the reaction progress). Reflux continued for two hours and the reaction mixture was poured into cold water. The precipitate was collected by filtration, washed with more water, and washed with small amount of cold methanol (TAI-10 is soluble in hot methanol). The yellow solid was then dried in an oven at 90° C. to give 2.6 g (22%) of Compound TAI-10. The structure was confirmed by mass spectroscopy. mp=275° C.

5-Fluoro-4-hydroxy-6-methyl-1,3,3a,7-tetraazaindene—TAI-11

3-Amino-1,2,4-triazole (4.2 g, 0.05 mol) and ethyl-2-fluoro-acetoacetate (11.376 g, 0.0768 mol) were refluxed in acetic acid (15 ml) under a nitrogen atmosphere for four hours. A white precipitate was formed. The reaction mixture was poured into cold water, filtered off, washed with more water, dried in air, and dried in an oven at 90° C. to give 3.5 g (42%) of pure TAI-11. mp=273° C.

Preparation of Sodium Salts of Tetraazaindene Compounds

To an aqueous slurry of tetraazaindene compound (0.233 mol) was added 100 g of 2N NaOH solution followed by addition of de-ionized water to give a total weight of 2,000 g. The mixture was heated and sonicated at 40° C. until all solid dissolved. The solution was stored at room temperature until used.

Preparation of TAI-4 Dispersion

An aqueous slurry of Compound TAI-4 and CELVOL® V603 polyvinyl alcohol was milled on a ball mill. The polyvinyl alcohol was added at a level of 27.0%. Filtration to remove the milling media afforded a finished dispersion having an average particle size of approximately 0.6 μm and containing 10.0% of compound TAI-4

EXAMPLE 1

Preparation of Aqueous-Based Photothermographic Materials Containing Tetraazaindene Compounds An aqueous-based photothermographic material of this invention was prepared in the following manner.

Preparation of Compound PS-1 Dispersion:

An aqueous slurry containing Compound PS-1, CELVOL® V603 polyvinyl alcohol, and BYK-022 was milled on a ball mill. The polyvinyl alcohol and BYK-022 were added at a level of 15.0%, and 0.1% by weight of PS-1, respectively. Filtration to remove the milling media afforded a finished dispersion having an average particle size of 0.83 μm with 7.52% of Compound PS-1.

Preparation of Compound D-1 Dispersions:

Aqueous slurries were prepared containing Compound D-1, CELVOL® 203S polyvinyl alcohol, TRITON® X-114 surfactant, and BYK-022. The polyvinyl alcohol, TRITON®X-114 surfactant, and BYK-022 were added at a level of 10.0%, 3.0%, and 0.1% by weight to that of Compound D-1, respectively. The mixture was milled with 0.7 mm zirconium ceramic beads for about 7 hours. Filtration to remove the beads gave a final dispersion. Transmitted light microscopy at 1000× magnification showed well-dispersed particles, all below 1 μm.

Preparation of AgBZT/AgT-1 Co-Precipitated Emulsion:

A co-precipitated AgBZT/AgT-1 emulsion was prepared as described in copending and commonly assigned U.S. Ser. No. 10/935,384 (noted above).

A stirred reaction vessel was charged with 900 g of lime-processed gelatin, and 6000 g of deionized water. The mixture in the reaction vessel was adjusted to a pH of 8.9 with 2.5N sodium hydroxide solution, and 0.8 g of Solution A (prepared below) was added to adjust the solution vAg to 80 mV. The temperature of the reaction vessel was maintained at approximately 50° C.

Solution A was prepared containing 216 g/kg of benzotriazole, 710 g/kg of deionized water, and 74 g/kg of sodium hydroxide.

Solution B was prepared containing 362 g/kg of silver nitrate and 638 g/kg of deionized water.

Solution C was prepared containing 336 g/kg of T-1, 70 g/kg of sodium hydroxide and 594 g/kg of deionized water.

Solutions A and B were then added to the reaction vessel by conventional controlled double-jet addition. Solution B was continuously added at the flow rates and for the times given below, while maintaining constant vAg and pH in the reaction vessel. After consumption of 97.4% total silver nitrate solution (Solution B), Solution A was replaced with Solution C and the precipitation was continued. Solution B and Solution C were added to the reaction vessel also by conventional controlled double-jet addition, while maintaining constant vAg and pH in the reaction vessel.

The AgBZT/AgT-1 co-precipitated emulsions were washed by conventional ultrafiltration process as described in *Research Disclosure*, Vol. 131, March 1975, Item 13122. The pH of AgBZT/AgT-1 emulsions was adjusted to 6.0 using 2.0N sulfuric acid. Upon cooling the emulsion solidified and was stored.

| | Time [min] | Solution B Flow Rate [ml/min] |
|---|---|---|
| Flow Rate 1 | 20 | 25 |
| Flow Rate 2 | 41 | 25–40 |
| Flow Rate 3 | 30 | 40–80 |

Preparation of Ultra-Thin Tabular Grain Silver Halide Emulsion:

A reaction vessel equipped with a stirrer was charged with 6 liters of water containing 2.1 g of deionized oxidized-methionine lime-processed bone gelatin, 3.49 g of sodium bromide, and an antifoamant (at pH=5.8). The solution was held at 39° C. for 5 minutes. Simultaneous additions were then made of 50.6 ml of 0.3 molar silver nitrate and 33.2 ml of 0.448 molar sodium bromide over 1 minute. Following nucleation, 3.0 ml of a 0.1 M solution of sulfuric acid was added. After 1 minute 15.62 g sodium chloride plus 375 mg of sodium thiocyanate were added and the temperature was increased to 54° C. over 9 minutes. After a 5-minute hold, 79.6 g of deionized oxidized-methionine lime-processed bone gelatin in 1.52 liters of water containing additional antifoamant at 54° C. were then added to the reactor. The reactor temperature was held for 7 minutes (pH=5.6).

During the next 36.8 minutes, the first growth stage took place (at 54° C.), in three segments, wherein solutions of 0.3 molar $AgNO_3$, 0.448 molar sodium bromide, and a 0.16 molar suspension of silver iodide (Lippmann) were added to maintain a nominal uniform iodide level of 3.2 mole %. The flow rates during this growth stage were increased from 9 to 42 ml/min (silver nitrate) and from 0.73 to 3.3 ml/min (silver iodide). The flow rates of the sodium bromide were allowed to fluctuate as needed to affect a monotonic pBr shift of 2.45 to 2.12 over the first 12 minutes, of 2.12 to 1.90 over the second 12 minutes, and of 1.90 to 1.67 over the last 12.8 minutes. This was followed by a 1.5-minute hold.

During the next 59 minutes the second growth stage took place (at 54° C.) during which solutions of 2.8 molar silver nitrate, and 3.0 molar sodium bromide, and a 0.16 molar suspension of silver iodide (Lippmann) were added to maintain a nominal iodide level of 3.2 mole %. The flow rates during this segment were increased from 10 to 39.6 ml/min (silver nitrate) and from 5.3 to 22.6 ml/min (silver iodide). The flow rates of the sodium bromide were allowed to fluctuate as needed to affect a monotonic pBr shift of 1.67 to 1.50. This was followed by a 1.5-minute hold.

During the next 34.95 minutes, the third growth stage took place during which solutions of 2.8 molar silver nitrate, 3.0 molar sodium bromide, and a 0.16 molar suspension of silver iodide (Lippmann) were added to maintain a nominal iodide level of 3.2 mole %. The flow rates during this segment were 39.6 ml/min (silver nitrate) and 22.6 ml/min (silver iodide). The temperature was linearly decreased to 35° C. during this segment. At the $23^{rd}$ minute of this segment a 50 ml aqueous solution containing 0.85 mg of an Iridium dopant ($K_2[Ir(5\text{-Br-thiazole})Cl_5]$) was added. The flow rate of the sodium bromide was allowed to fluctuate to maintain a constant pBr of 1.50.

A total of 8.5 moles of silver iodobromide (3.2% bulk iodide) were formed. The resulting emulsion was washed using ultrafiltration. Deionized lime-processed bone gelatin (326.9 g) was added along with a biocide and pH and pBr were adjusted to 6 and 2.5 respectively.

The resulting emulsion was examined by Scanning Electron Microscopy. Tabular grains accounted for greater than 99% of the total projected area. The mean ECD of the grains was 2.522 μm. The mean tabular thickness was 0.049 μm.

This emulsion was spectrally sensitized with 3.31 mmol of blue sensitizing dye SSD-1 per mole of silver halide. This dye quantity was split 80%/20% with the majority being added before chemical sensitization and the remainder afterwards. Chemical sensitization was carried out using 0.0085 mmol of sulfur sensitizer (compound SS-la) and 0.00079 mmol per mole of silver halide of gold sensitizer (compound GS-1) at 60° C. for 6.3 minutes.

Preparation of Photothermographic Materials:

Component A: The AgBZT/AgT-1 co-precipitated emulsion prepared above and hydrated gelatin (35% gelatin/65% water) were placed in a beaker and heated to 50° C. for 15 minutes. A 5% aqueous solution of 3-methyl-benzothiazolium iodide was added and the mixture was heated for 15 minutes at 50° C. A 0.73 molar aqueous solution of sodium salt of benzotriazole was added and the mixture was heated for 10 minutes at 50° C. The mixture was cooled to 40° C. and its pH was adjusted to 5.0 with 2.5N sulfuric acid. An 18% aqueous solution of Compound A-1 was added and the mixture was heated for 10 minutes at 40° C. A 4% active aqueous solution of Zonyl FS-300 was then added and the mixture was held at 40° C.

Component B: A portion of the ultra-thin tabular grain silver halide emulsion prepared above was placed in a beaker and melted at 40° C.

Component C: 1,3-Dimethyl urea, succinimide, and xylitol were dissolved in water by heating at 50° C. The dispersions of Compounds D-1 and PS-1 described above were added to the above solution at room temperature.

Component D: Boric acid and 1,3-dimethylurea were dissolved in water by heating at 50° C. The solution was cooled to room temperature. A portion of deionized lime-processed gelatin was added to the solution to be hydrated for 30 min. The mixture was heated to 40° C. for 10 minutes to melt the gelatin. A portion of a dispersion of 6.5 μm polystyrene beads in gelatin was placed in another beaker and heated to 40° C. for 10 minutes to melt the gelatin. Both melts were combined and the mixture was added a 4% active aqueous solution of Zonyl FS-300. This was followed by addition of a dispersion of the tetraazaindene compound.

Component E: A 1.7% aqueous solution of compound VS-1 was prepared by dissolving VS-1 in water at 50° C.

Coating and Evaluation of Photothermographic Materials:

Components A, B, and C were mixed immediately before coating to form a photothermographic emulsion formulation, and components D and E were mixed immediately before coating to form a overcoat formulation. The photothermographic formulation and the overcoat formulation were coated as a dual layer on a 7 mil (178 μm) transparent, blue-tinted poly(ethylene terephthalate) film support using a conventional automated dual-knife coating machine. The coating gaps for both layers were adjusted to achieve the dry coating weights shown in TABLE I. Samples were dried at 120° F. (48.9° C.) for 10 minutes.

TABLE I

| Component | Compound | Dry Coating Weight ($g/m^2$) |
|---|---|---|
| Photothermographic Layer | | |
| A | Silver (from AgBZT/AgT-1) | 1.45 |
| A | Lime processed gelatin | 2.22 |
| A | 3-Methylbenzothiazolium Iodide | 0.074 |
| A | Sodium benzotriazole | 0.087 |

TABLE I-continued

| Component | Compound | Dry Coating Weight (g/m$^2$) |
|---|---|---|
| A | Compound A-1 | 0.074 |
| A | Zonyl FS-300 | 0.021 |
| B | Silver (from AgBrI emulsion) | 0.26 |
| C | 1,3-Dimethyl urea | 0.30 |
| C | Succinimide | 0.14 |
| C | Xylitol | 0.45 |
| C | Compound PS-1 | 0.03 |
| C | Compound D-1 | 3.77 |
| Overcoat Layer | | |
| D | Deionized lime-processed gelatin | 1.56 |
| D | Boric acid | 0.048 |
| D | 1,3-Dimethyl urea | 0.30 |
| D | Zonyl FS-300 | 0.073 |
| D | Tetraazaindene compound | See TABLE II |
| D | 6.5 μm Polystyrene beads | 0.098 |
| E | Compound VS-1 | 0.086 |

TABLE II

| Sample | Inventive/ Comparative | Compound | Coating Weight (mg/ft$^2$) | Coating Weight [mg/m$^2$] |
|---|---|---|---|---|
| 1-1-C | Comparative | None | 0.00 | [0.00] |
| 1-2-I | Inventive | TAI-4 | 1.25 | [13.5] |
| 1-3-I | Inventive | TAI-4 | 2.50 | [26.9] |
| 1-4-I | Inventive | TAI-4 | 5.00 | [53.8] |

The resulting photothermographic films were imaged using a sensitometer equipped with filters to provide an exposure simulating a phosphor emitting at 390 to 395 nm. Exposure was for 1/10 second using a 3000° K tungsten lamp. Following exposure, the films were developed on a heated flat bed processor for 18 seconds at 150° C. to generate continuous tone wedges.

Densitometry measurements were made on a custom built computer-scanned densitometer meeting ISO Standards 5-2 and 5-3 and are believed to be comparable to measurements from commercially available densitometers. Density of the wedges was measured with above computer densitometer using a filter appropriate to the sensitivity of the photothermographic material to obtain graphs of density versus log exposure (that is, D log E curves). $D_{min}$ is the density of the non-exposed areas after development and it is the average of the eight lowest density values. These samples provided initial values for $D_{min}$, $D_{max}$, Speed-1, and Speed-2 and are shown in TABLE III.

TABLE III

| Samples Developed for 18 Seconds | | | | |
|---|---|---|---|---|
| Sample | Dmin | Dmax | Speed-1 | Speed-2 |
| 1-1-C | 0.328 | 2.384 | 5.968 | 5.558 |
| 1-2-I | 0.304 | 2.109 | 5.861 | 5.341 |
| 1-3-I | 0.306 | 2.083 | 5.858 | 5.292 |
| 1-4-I | 0.315 | 2.332 | 5.889 | 5.435 |

Natural Age Keeping:

Non-imaged samples were stored in a black polyethylene bag for 6 weeks at ambient room temperature and relative humidity to determine their Natural Age Keeping properties. The samples were then imaged, developed for 18 seconds, and compared with the freshly imaged samples. The results are shown below in TABLE IV.

The change in properties (Δ) upon Natural Age Keeping was also determined. The results, shown below in TABLES IV and V demonstrate that photothermographic materials incorporating a halogen substituted tetraazaindene compound, improves the natural age keeping of the photothermographic films and especially provides a smaller increase in $D_{min}$ ($\Delta D_{min}$) and a smaller decrease in Speed-2 (ΔSpeed-2) than photothermographic materials not containing a halogen-substituted tetraazaindene compound.

TABLE IV

| Samples Stored for 6 Weeks | | | | |
|---|---|---|---|---|
| Sample | Dmin | Dmax | Speed-1 | Speed-2 |
| 1-1-C | Sample Fogged | | | |
| 1-2-I | 0.635 | 1.798 | 6.043 | NA |
| 1-3-I | 0.497 | 1.369 | 6.039 | NA |
| 1-4-I | 0.362 | 1.705 | 6.052 | 5.114 |

TABLE V

| Change in Sensitometry after Storage for 6 Weeks | | | | |
|---|---|---|---|---|
| Sample | ΔDmin | ΔDmax | ΔSpeed-1 | ΔSpeed-2 |
| 1-1-C | Sample Fogged | | | |
| 1-2-I | 0.331 | −0.311 | 0.182 | NA |
| 1-3-I | 0.191 | −0.714 | 0.181 | NA |
| 1-4-I | 0.047 | −0.627 | 0.163 | −0.321 |

Dark Stability Test:

Imaged samples of each film were illuminated with 100 foot-candles (1076 lux) at 70° F. (21.2° C.) and 50% relative humidity for 2 hours.

The samples were then sealed in a light and humidity tight aluminum bag and stored for 48 hours at 120° F. (48.9° C.) and 50% relative humidity. The $D_{min}$ of the samples was measured before and after storage using an X-Rite® Model 301 densitometer (X-Rite Inc. Grandville, Mich.). Two measurements were made on each sample. For the first measurement, the densitometer was equipped with a visible filter with a transmittance peak at about 530 nm. In the second measurement, the densitometer was fitted with a blue filter with a transmission peak at about 440 nm. The difference in density before and after storage using these filters is reported below in TABLE VI as "Dark Stability" (Δ Density Blue+Δ Density Visible) and demonstrates that inventive samples containing a halogen-substituted tetraazaindene compounds show less increase in $D_{min}$ (increased background density or "print-out") when tested for dark stability and compared to control samples not incorporating a halogen substituted tetraazaindene compound.

TABLE VI

| Dark Stability | |
|---|---|
| Sample | $\Delta D_{Blue} + \Delta D_{Visible}$ |
| 1-1-C | 0.62 |
| 1-2-I | 0.87 |
| 1-3-I | 0.51 |
| 1-4-I | 0.35 |

EXAMPLE 2

Comparison of Halogen-Substituted Tetraazaindenes with Non-Halogen-Substituted Tetraazaindenes in Aqueous Photothermographic Materials Preparation of Photothermographic Materials:

Photothermographic samples containing aqueous solutions of the sodium salts of bromo-substituted and non-halogen substituted tetraazaindene compounds were prepared and coated using the procedures described in Example 1 except that an aqueous solution of Compound S-1 was added to Component B in an amount to provide a dry coating weight of 2.2 mg/m$^2$.

TABLE VII

| Sample | Inventive/ Comparative | Compound | Coating Weight (mg/ft$^2$) | Coating Weight [mg/m$^2$] |
|---|---|---|---|---|
| 2-1-C | Comparative | None | 0.0 | [0.0] |
| 2-2-C | Comparative | TAI-C-1 | 1.0 | [10.8] |
| 2-3-C | Comparative | TAI-C-1 | 2.0 | [21.5] |
| 2-4-C | Comparative | TAI-C-2 | 1.0 | [10.8] |
| 2-5-C | Comparative | TAI-C-2 | 2.0 | [21.5] |
| 2-6-I | Inventive | TAI-2 | 2.0 | [21.5] |
| 2-7-I | Inventive | TAI-2 | 1.0 | [10.8] |

The resulting photothermographic films were imagewise exposed and developed as described in Example 1. The results, shown below in TABLE VIII, demonstrate similar $D_{min}$, $D_{max}$, and Speed-2 with the halogen-substituted tetraazaindene compounds as compared to photothermographic materials containing no tetraazaindene compound or containing a tetraazaindene compound not having a halogen substituent.

TABLE VIII

| Samples Developed for 18 Seconds | | | | |
|---|---|---|---|---|
| Sample | Dmin | Dmax | Speed-1 | Speed-2 |
| 2-1-C | 0.296 | 2.168 | 5.887 | 5.410 |
| 2-1-C | 0.296 | 2.168 | 5.887 | 5.410 |
| 2-2-C | 0.315 | 2.492 | 6.012 | 5.580 |
| 2-3-C | 0.310 | 2.497 | 6.015 | 5.574 |
| 2-4-C | 0.350 | 2.401 | 6.011 | 5.611 |
| 2-5-C | 0.346 | 2.359 | 5.988 | 5.553 |
| 2-6-I | 0.293 | 1.961 | 5.943 | 5.390 |
| 2-7-I | 0.292 | 2.181 | 5.978 | 5.456 |

Dark Stability of the samples was determined as described in Example 1. The results, shown below in TABLE IX, demonstrate that inventive samples containing a halogen-substituted tetraazaindene compound show less increase in $D_{min}$ (increased background density or "print-out") when tested for dark stability and compared to control samples incorporating a non-halogen substituted tetraazaindene compound.

TABLE IX

| Dark Stability | |
|---|---|
| Sample | $\Delta D_{Blue} + \Delta D_{Visible}$ |
| 2-1-C | 0.61 |
| 2-2-C | 0.59 |

TABLE IX-continued

| Dark Stability | |
|---|---|
| Sample | $\Delta D_{Blue} + \Delta D_{Visible}$ |
| 2-3-C | 0.86 |
| 2-4-C | 0.71 |
| 2-5-C | 0.82 |
| 2-6-I | 0.34 |
| 2-7-I | 0.34 |

EXAMPLE 3

Preparation of Photothermographic Materials:

Photothermographic samples containing chloro-, fluoro-, and unsubstituted tetraazaindene compounds were prepared and coated using the procedures described in Example 1 except that an aqueous solution of Compound S-1 was added in an amount to provide a dry coating weight of 2.2 mg/M$^2$.

TABLE X

| Sample | Inventive/ Comparative | Compound | Coating Weight (mg/ft$^2$) | Coating Weight [mg/m$^2$] |
|---|---|---|---|---|
| 3-1-C | Comparative | None | 0.0 | [0.0] |
| 3-2-I | Inventive | TAI-2 | 2.0 | [21.8] |
| 3-3-I | Inventive | TAI-12 | 2.0 | [21.8] |
| 3-4-I | Inventive | TAI-12 | 4.0 | [43.0] |
| 3-5-I | Inventive | TAI-1 | 2.0 | [21.8] |

The resulting photothermographic films were imagewise exposed and developed as described in Example 1. The results, shown below in TABLE XI, demonstrate similar $D_{min}$, $D_{max}$, and Speed-2 with the halogen-substituted tetraazaindene compounds as compared to photothermographic materials containing no tetraazaindene compound.

TABLE XI

| Samples Developed for 18 Seconds | | | | |
|---|---|---|---|---|
| Sample | Dmin | Dmax | Speed-1 | Speed-2 |
| 3-1-C | 0.294 | 2.242 | 5.441 | 4.974 |
| 3-2-I | 0.304 | 2.265 | 5.415 | 4.949 |
| 3-3-I | 0.301 | 2.192 | 5.391 | 4.915 |
| 3-4-I | 0.307 | 2.185 | 5.387 | 4.913 |
| 3-5-I | 0.340 | 2.664 | 5.441 | 5.061 |

Dark Stability of the samples was determined as described in Example 1. The results, shown below in TABLE XII, demonstrate that inventive samples containing a halogen-substituted tetraazaindene compound show less increase in $D_{min}$ (increased background density or "print-out") when tested for dark stability and compared to control samples.

TABLE XII

| Dark Stability | |
|---|---|
| Sample | $\Delta D_{Blue} + \Delta D_{Visible}$ |
| 3-1-C | 0.78 |
| 3-2-I | 0.55 |
| 3-3-I | 0.59 |
| 3-3-I | 0.52 |
| 3-4-I | 0.45 |

The invention has been described in detail with particular reference to certain preferred embodiments thereof, but it will be understood that variations and modifications can be effected within the spirit and scope of the invention.

The invention claimed is:

1. A black-and-white aqueous-based photothermographic material comprising a support and having thereon at least one photothermographic imaging layer comprising a hydrophilic polymer binder or a water-dispersible polymer latex binder and in reactive association:

a. a photosensitive silver halide, b. a non-photosensitive source of reducible silver ions, c. a reducing agent for said reducible silver ions, and d. at least 0.00002 mol/$m^2$ of a halogen-substituted tetraazaindene compound.

2. The material of claim 1 wherein said halogen-substituted tetraazaindene compound has an alkyl, aryl, or cycloalkyl, group in the 6-position.

3. The material of claim 1 wherein said halogen-substituted tetraazaindene compound is represented by the following Structure (I):

(I)

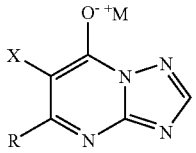

wherein X is a fluoro, chloro, or bromo group, $M^+$ is hydrogen or an alkali metal or ammonium ion, and R is an alkyl, aryl, or cycloalkyl group.

4. The material of claim 3 wherein R is an alkyl group having 1 to 4 carbon atoms and $M^+$ is hydrogen or an alkali metal ion.

5. The material of claim 1 wherein said halogen-substituted tetraazaindene compound includes one or more of the following compounds TAI-1 through TAI-14:

(TAI-1)

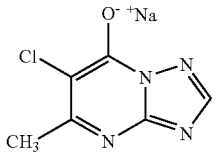

(TAI-2)

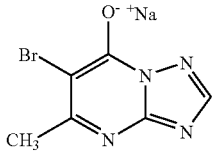

(TAI-3)

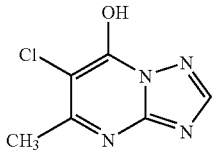

-continued (TAI-4)

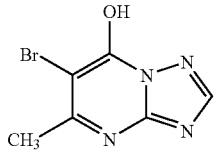

(TAI-5)

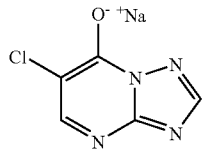

(TAI-6)

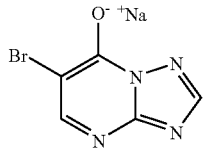

(TAI-7)

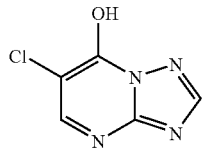

(TAI-8)

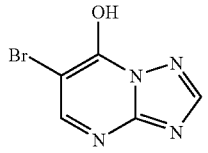

(TAI-9)

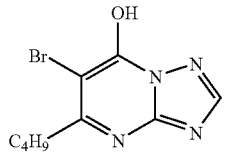

(TAI-10)

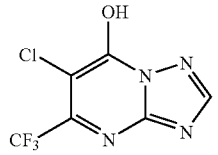

(TAI-11)

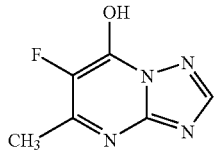

(TAI-12)

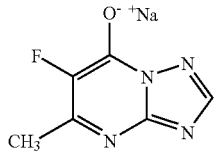

-continued (TAI-13)

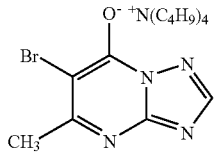

(TAI-14)

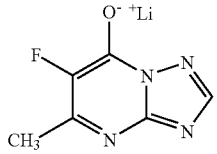

6. The material of claim 5 wherein said halogen-substituted tetraazaindene compound is one or more of Compounds TAI-1, TAI-2, TAI-3, TAI-4, TAI-11, and TAI-12.

7. The material of claim 1 wherein said halogen-substituted tetraazaindene compound is present in an amount of from about 0.0001 to about 0.001 mol/$m^2$.

8. The material of claim 1 wherein said halogen-substituted tetraazaindene compound is present in said photothermographic imaging layer.

9. The material of claim 1 wherein said non-photosensitive source of reducible silver ions is a silver salt of a nitrogen-containing heterocyclic compound containing an imino group, said reducing agent is an ascorbic acid or a reductone, and said photosensitive silver halide is present predominantly as tabular silver halide grains.

10. The material of claim 1 wherein said non-photosensitive source of reducible silver ions comprises a silver benzotriazole, said reducing agent is a fatty acid ester of ascorbic acid, and said hydrophilic binder is gelatin, a gelatin derivative, or a cellulosic material, and said material further comprising a protective overcoat disposed over said one or more photothermographic imaging layers, and said protective overcoat comprises gelatin or a gelatin derivative as the binder.

11. A black-and-white photothermographic material comprising a support having on a frontside thereof, a) one or more frontside photothermographic imaging layers comprising a hydrophilic polymer binder or a water-dispersible polymer latex binder, and in reactive association, a photosensitive silver halide, a non-photosensitive source of reducible silver ions, and a reducing agent for said non-photosensitive source reducible silver ions, b) said material comprising on the backside of said support, one or more backside photothermographic imaging layers having the same or different composition as said photothermographic imaging layers, and c) optionally, an outermost protective layer disposed over said one or more photothermographic imaging layers on either or both sides of said support, wherein said material further comprises, on one or both sides of said support, at least 0.0002 mol/$m^2$ of a halogen-substituted tetraazaindene compound.

12. The material of claim 11 wherein said photosensitive silver halide is sensitive to electromagnetic radiation of from about 300 to about 450 nm.

13. The material of claim 11 wherein said photothermographic imaging layers on both sides of said support are essentially the same, said non-photosensitive source of reducible silver ions is a silver benzotriazole, said reducing agent is a fatty acid ester of ascorbic acid, said photosensitive silver halide is present predominantly as tabular grains of silver bromide or silver iodobromide, and said halogen-substituted tetraazaindene compound on both sides of said support is the same compound represented by the following Structure (I):

(I)

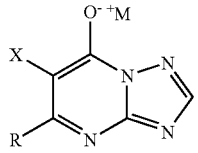

wherein X is a fluoro, chloro, or bromo group, $M^+$ is hydrogen, $Li^+$, $Na^+$, or $K^+$, and R is an alkyl group having 1 to 4 carbon atoms.

14. The material of claim 11 wherein said photothermographic imaging layers on both sides of said support have been coated as an aqueous formulation comprising an aqueous solvent, and said outermost protective overcoat layer comprises gelatin or a gelatin derivative as the binder.

15. A method of forming a visible image comprising:

(A) imagewise exposing the photothermographic material of claim 1 to form a latent image, (B) simultaneously or sequentially, heating said exposed photothermographic material to develop said latent image into a visible image.

16. The method of claim 15 wherein said photothermographic material is arranged in association with one or more phosphor intensifying screens during imaging.

17. The method of claim 15 further comprising using said exposed photothermographic material for medical diagnosis.

18. An imaging assembly comprising the photothermographic material of claim 1 that is arranged in association with one or more phosphor intensifying screens.

19. The imaging assembly of claim 18 wherein said photothermographic material comprises a photosensitive silver halide that is spectrally sensitive to a wavelength of from about 300 to about 450 nm, and said phosphor intensifying screens are capable of emitting radiation in the range of from about 300 to about 450 nm.

* * * * *